US005833042A

United States Patent [19]

Baitch et al.

[11] Patent Number: 5,833,042

[45] Date of Patent: Nov. 10, 1998

[54] COIN DISCRIMINATOR

[75] Inventors: Alexander Baitch, Castle Hill; Lawrence Peter Phillips, St. Ives; Norman Raymond Malzard, Seven Hills; Phillip Andrew Wolstoncroft, Mittagong; Nikola Korecki, Cronulla, all of Australia

[73] Assignee: Microsystem Controls Pty Ltd, South Melbourne, Australia

[21] Appl. No.: 652,471

[22] PCT Filed: Dec. 19, 1994

[86] PCT No.: PCT/AU94/00777

§ 371 Date: Jun. 17, 1996

§ 102(e) Date: Jun. 17, 1996

[87] PCT Pub. No.: WO95/16978

PCT Pub. Date: Jun. 22, 1995

[30] Foreign Application Priority Data

Dec. 17, 1993 [AU] Australia ..... PM3019

[51] Int. Cl.[6] ..... G07D 5/08

[52] U.S. Cl. ..... 194/317

[58] Field of Search ..... 194/317, 318, 194/319

[56] References Cited

U.S. PATENT DOCUMENTS

| | | | |
|---|---|---|---|
| 3,918,565 | 11/1975 | Fougere et al. . | |
| 5,020,653 | 6/1991 | Shimizu | 194/317 |

FOREIGN PATENT DOCUMENTS

| | | |
|---|---|---|
| 577777 | 8/1984 | Australia . |
| 0 300 781 | 1/1989 | European Pat. Off. . |
| 2 041 532 | 9/1980 | United Kingdom . |
| WO 92/10270 | 1/1992 | WIPO . |

*Primary Examiner*—F. J. Bartuska
*Attorney, Agent, or Firm*—Banner & Witcoff, Ltd.

[57] ABSTRACT

A method of categorizing coins/tokens by energizing detect coils with a single pulse detecting the back EMF curve of the decaying pulse information, analyzing the unmodified back EMF curve to extract therefrom a number of variables and processing those variables to provide values proportional to the variables, and comparing the values of the coin/token to at least one of a number of reference values to determine into which of a number of predetermined categories the coin/token falls.

16 Claims, 36 Drawing Sheets

COIN DISCRIMINATOR

FIELD OF THE INVENTION

This invention relates to a method and apparatus for discriminating between coins, tokens or similar articles.

BACKGROUND OF THE INVENTION

Coin-operated apparatus are being increasingly used throughout the world to provide goods and services. Such apparatus includes amusement machines, vending machines for a wide variety of products, gaming machines (such as "poker machines") and pay phones.

As a sub-group, vending machines dispensing such varied products as public transport tickets, confectionery, video cassettes and bread sticks are increasingly apparent in developed countries due to the high cost of labour and a demand for twenty-four-hour access to such products.

In addition, public telephones or pay phones are becoming more sophisticated. Although there is a trend towards pay telephones which operate only on a debit card or credit card, it is likely that future pay telephones will be modelled on those currently in use in Italy, in which one may use coins, cards or gettoni (telephone tokens).

Although there are in use banknote validators, the problems inherent in "reading" banknotes (particularly mutilated or worn banknotes) coupled with the trend in most countries to replace lower denomination banknotes with coins, means that in all of the abovementioned applications, a coin validator will be required.

To be acceptable in one of the abovementioned applications, a coin discriminator must quickly and accurately discriminate between coins of different denomination, between coins of different countries and between genuine coins and bogus coins. Existing coin discriminators have been unable to discriminate adequately, in some cases, between a low value coin of a foreign country and a higher value coin of the country in which the validator is located. Particularly in a region such as Europe, coin discriminators additionally cannot cope with the large number of migratory coins from various European countries.

One example of a prior art coin validator is provided by U.S. Pat. No. 3,918,565, which discloses coin selection methods and apparatus in which data representative of a coin is compared with data stored in a programmable memory.

In U.S. Pat. No. 3,918,565, a numerical value of a signal produced by interrogating a coin, such as frequency, is compared with acceptable numerical values for genuine coins which are stored in the programmable memory.

Another prior art coin validator is disclosed in AU-B-24242/84, which discloses the use of pulsing coils which induce eddy currents in a coin. Monitoring means is used to monitor the decay of the eddy currents, and a comparison between the output of the monitoring means and stored reference values enable discrimination to take place. It is considered that the approach of AU-B-24242/84 is unnecessarily complicated, and would not permit an adequately rapid discrimination to take place.

In U.S. Pat. No. 5,020,652 to Shimizu there is disclosed a device for discriminating between different coins, such a real or counterfeit coins, without contacting the coins. Shimizu uses a coil to provide a pulse of a magnetic field into the coin, and then detects the decaying curve of the back EMF created by the eddy currents in the coin. The characterstics of that decaying curve are determined by the material of the coin, its diameter and thickness, and any surface treatment. Therefore, for non-identical coins, the decaying curves are also non-identical.

After detecting the decaying curves Shimizu then subjects the decaying curve to series of manipulations prior to comparing the characteristics of the decaying curve with the known characteristics for known coins. Those manipulations include the use of a switched-gain amplifier, and an analogue-to-digital converter. Also, Shimizu uses a binary counter to determine the end of each cycle so the amplification factor can be increased for the following half cycle.

This creates an analysis regime which is unnecessarily complex. It also means that the inherent characteristics of the decaying curve are not used, but rather a digital signal derived from a modified form of the curve. In this way, certain inherent characteristics of the coin being tested may not as accurately be determined. Furthermore, with Shimizu, an amplified and digitised representation of the decaying waveform is fed into the microprocessor for direct comparison with the known waveforms of particular coins.

In Australian Patent Application No. AU81826/91, another approach is disclosed using pulsing of coins. In particular, it included the steps of, (i) energising detect coils, with a single pulse, between which at least part of a coin is located, (ii) extracting from at least one portion of the back EMF curve of the decaying pulse information to provide a definition of the coin, each portion of said back EMF curve being inverted and amplified, and (ii) comparing in a microprocessor the definition of the coin with a reference definition, to determine whether the coin is acceptable or unacceptable. The definition is in the form of a period of time, or a number of system clock counts, which counts represent a period of time. The period of time relates to the time between a predetermined time, between the de-energisation of said coils, and the intersection of said back EMF curve with a reference voltage.

The inversion and amplification of the back EMF curve was required to produce a measurable signal capable of properly being used for validation purposes. However in so manipulating the curve, its ability to discriminate between extremely similar coin types is diminished.

Further investigations have been directed to optimising this type of discrimination method with emphasis on the significance of the back EMF oscillation curve.

DESCRIPTION OF A PREFERRED FORM OF THE INVENTION

In one preferred form of the invention an unmodified back emf oscillating waveform from a single pulse of a token/coin is used to provide information for discriminating coins/tokens. The unmodified back emf oscillating waveform is of increased significance in discrimination as it does not have important distinguishing characteristics excluded by subsequent manipulation of the type currently known. Preferably, and in direct contrast to Shimizu, from the unmodifed decaying wave are extracted a number of variables which are processed to provide values proportional to those variables, with those values being fed into a microprocessor for comparison with the corresponding values of those variables for coins of known denomination stored in the microprocessor to enable the category of the coin under test to be determined. Advantageously, the values are time values.

In particular, an improved method of coin/token discrimination is possible by non dampening of decay oscillation of the detect coil field. Such reference data being assembled on the basis of the unmodified oscillating waveform can be representative of a particular type of coin/token to the exclusion of very similar other coins/tokens.

Particularly characteristic data may be extracted from the unmodified back emf oscillating waveform to enhance discrimination between coins/tokens. Such characteristic data for a coin/token may include:

(i) superimposing a mean amplitude curve;

(ii) the phase and/or change in phase of each oscillating waveform;

(iii)

(a) the curves plotted by the peaks of either or both of the positive and/or negative portions of the oscillating waveform; and (b) the amplitude of the negative and/or positive peaks of each oscillating waveform;

(iv) the area of the curves beneath the peaks of each oscillating waveform;

(v) the frequency and/or change in frequency of each oscillating waveform;

(vi) the decay of peaks of each oscillating waveform in a predetermined time; and (vii) any combination of the above.

Accordingly by analysing such details a refined signature can be attributed to a type of coin/token. By allowing appropriate variation, it is possible to accurately discriminate between coins/tokens.

More specifically, the invention provides a method of validating coins/tokens, including the steps of:

(a) energising detect coils, between which at least a part of a coin/token is located, with a single pulse, (b) detecting the back EMF curve of the decaying pulse information to provide a definition of said coin/token, said back EMF curve being substantially unmodified, (c) comparing said definition of said coin/token with at least one of a number of reference definitions to determine into which of a number of pre-determined categories said coin/token falls.

DESCRIPTION OF THE DRAWINGS

Embodiments of the invention will be illustrated in detail hereinafter with reference to the accompanying drawings, in which:

In FIGS. 1 to 10, "hardware" aspects of a known validator is disclosed to which the invention may be applied.

As shown the coin validator is a self-contained unit locatable in a particular apparatus, such that a coin introduced into the apparatus—whatever the apparatus may be—will travel past a detect coil in the validator, will be validated or invalidated, and as a consequence will emerge from one outlet or another outlet of the validator, and the appropriate signal will be sent to the particular apparatus for further action.

Figure 1:
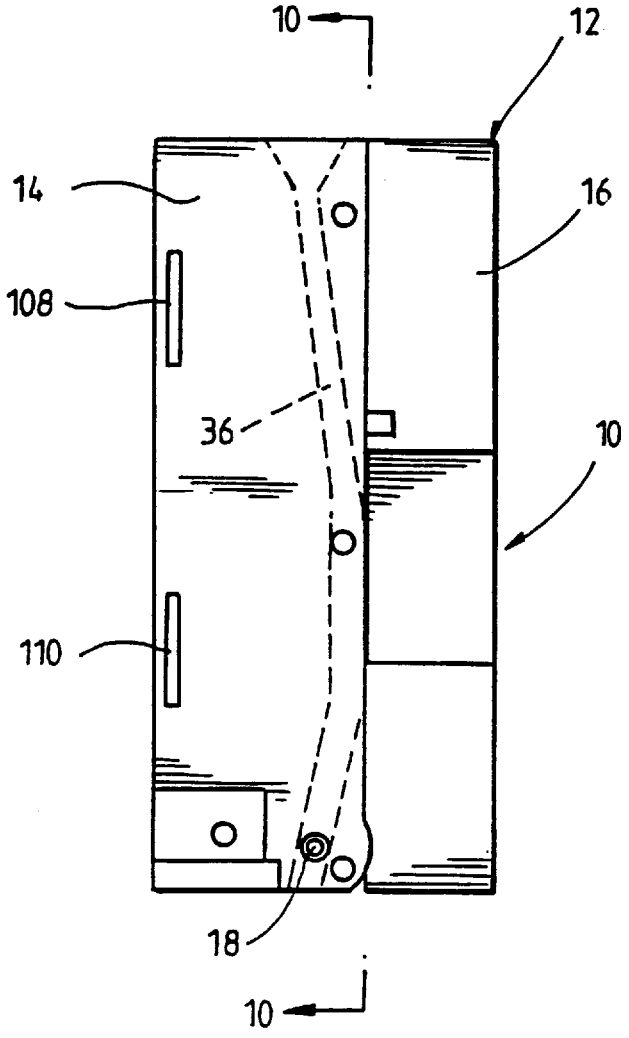
FIG. 1 is an end elevation of an elevation of an embodiment of a coin validator body according to the invention.
Figure 2:
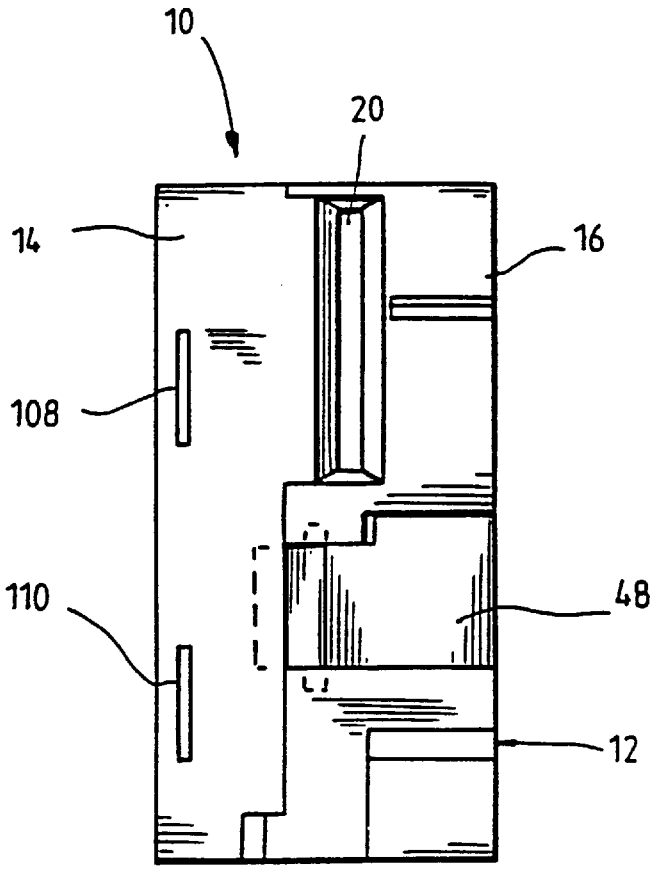
FIG. 2 is a top plan view of the coin validator of FIG. 1.
Figure 3:
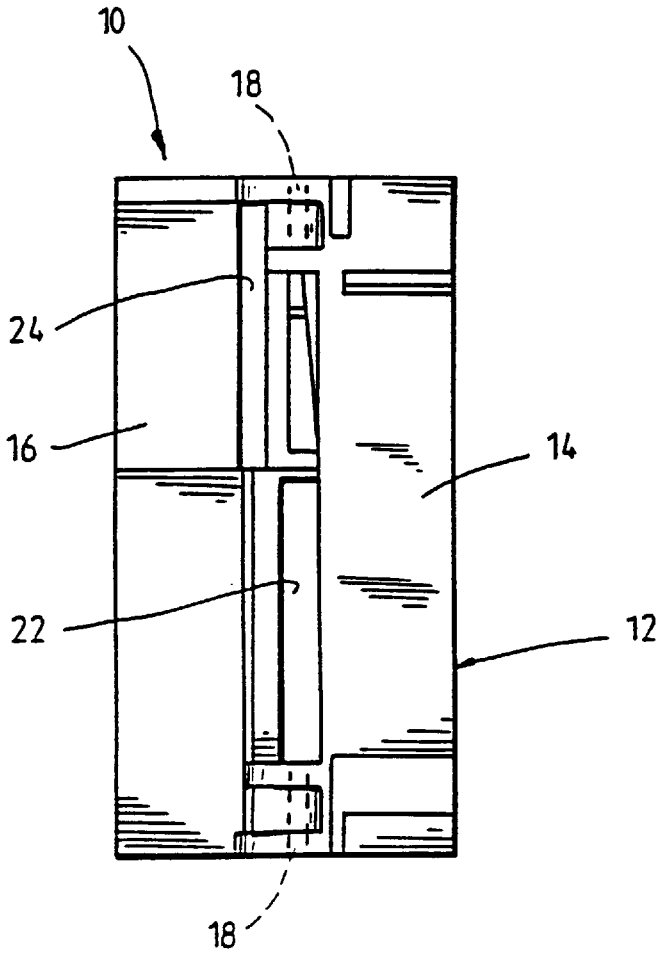
FIG. 3 is an underneath view of the coin validator of FIG. 1.

Referring firstly to FIGS. 1 to 3, the coin validator 10 of includes a body 12 which has two body portions 14 (main body) and 15 (subsidiary body), which are hinged together, as shown at 18.

Figure 5:
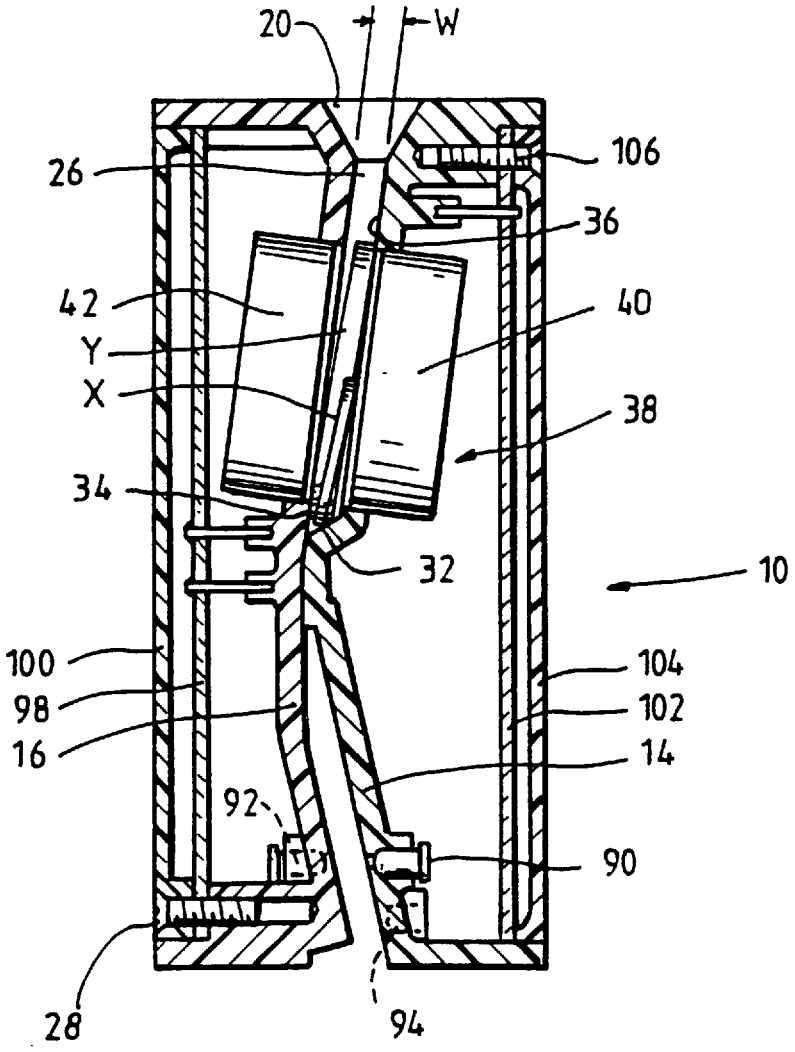
FIG. 5 is a section along the lines 5—5 of FIG. 4.

Within subsidiary body portion 16 there is a printed circuit board assembly 98, and a cover 100 is secured to body portion 16 by screws or the like, one of which is shown at 28 in FIG. 5.

Main body portion 14 has a printed circuit board assembly 102 located therein, and a cover 104 is secured to body portion 14 by screws or the like.

On printed circuit board assemblies 98, 102 may be located all the electrical and electronic components to operate, monitor and control the validator 10.

Main body cover 104 is adapted to hook into slots (108,110) on main body portion 14, and as stated before may be secured via screws such as 106.

To secure validator 10 to or in apparatus such as a vending machine, pins 112, 116, 118 may be used to attach the validator 10 to a bracket (not shown) in the apparatus.

The upper view of the generally cuboidal body 12 (FIG. 2) shows a coin entrance 20, and the underneath view (FIG. 3) shows an 'accept' outlet 22 and a 'reject' outlet 24.

Figure 4:
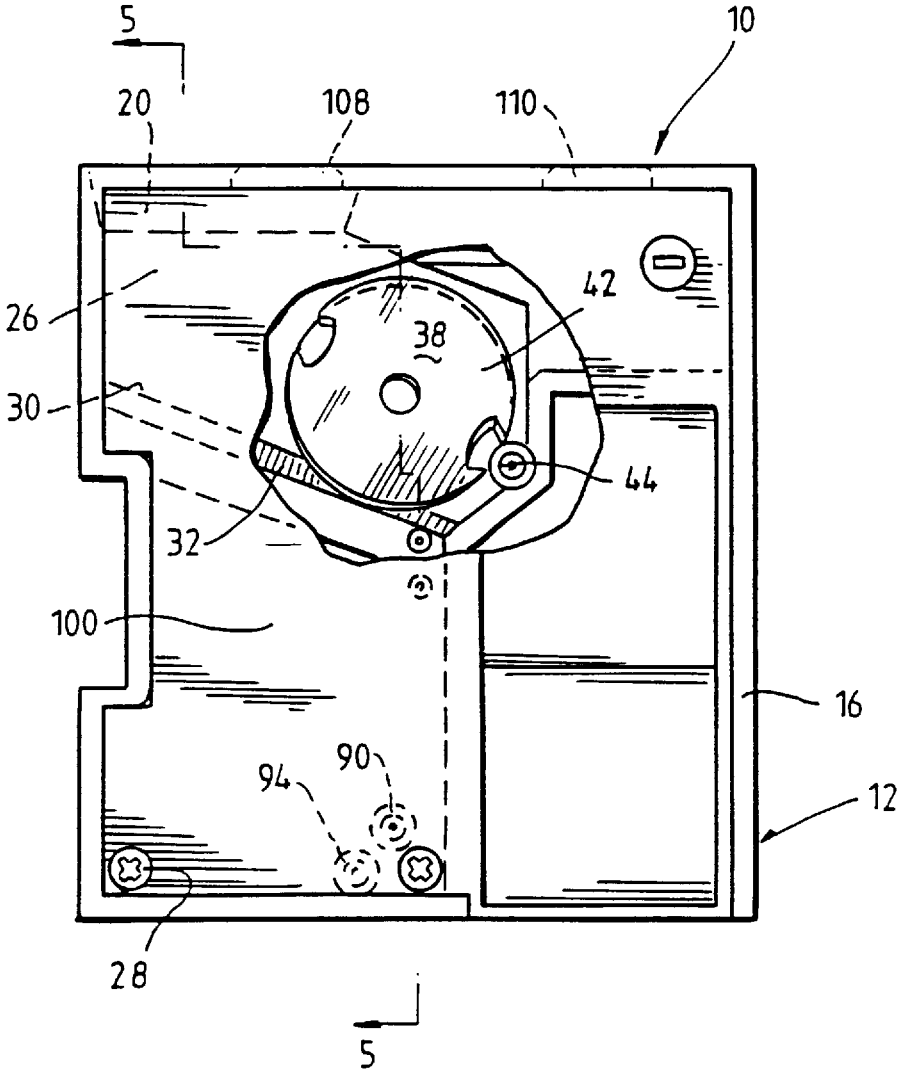
FIG. 4 is an elevation of a subsidiary body element of the body of FIG. 1.
Figure 6:
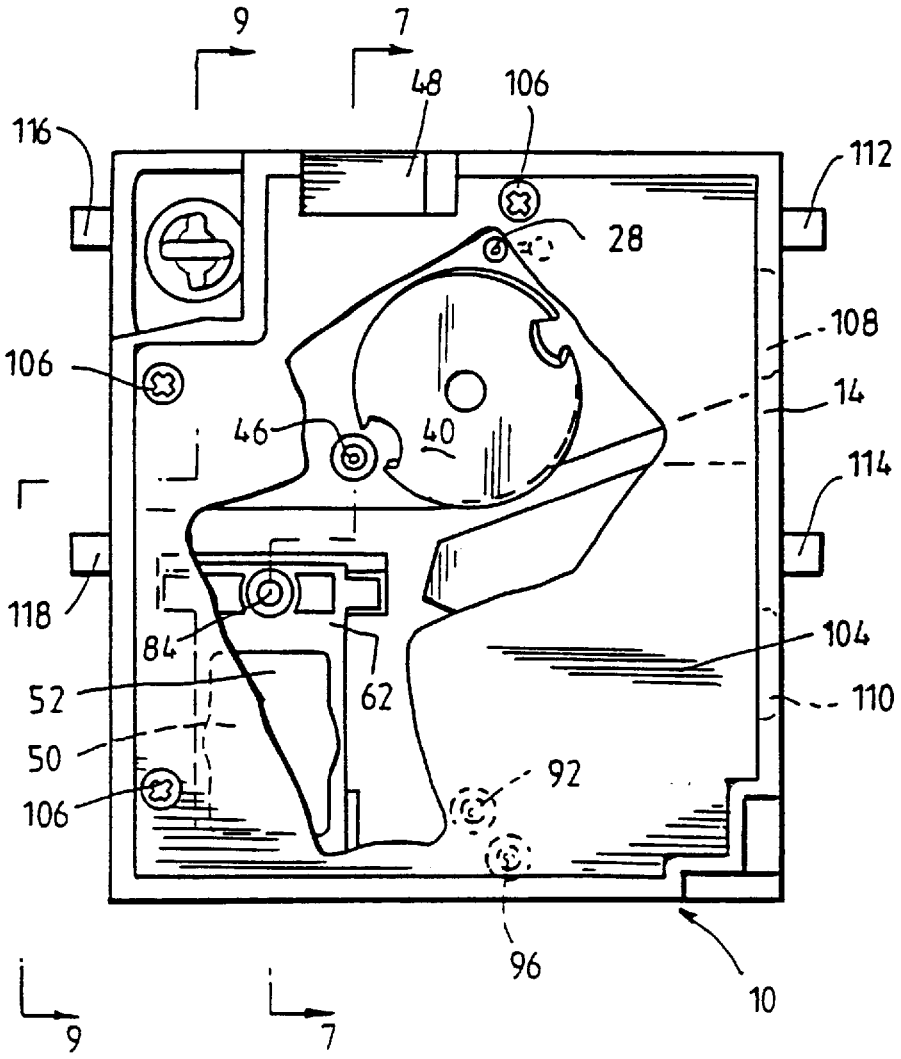
FIG. 6 is an elevation of a main body element of the body of FIG. 1.

Turning now to FIG. 4, 5 and 6, in particular FIG. 5, a coin path 26 extends from inlet 20. The width W of the coin path is selected to be the ninimum consistent with the thickness of the coins likely to be introduced into the validator 10 the width W is 3.5 mm, to accommodate the thickest known coin.

A first optical sensor 28 is located close to the start of coin path 26, the first part of which 30 is a downwardly inclined (FIGS. 4,5) and is angled from the vertical (FIG. 5).

In FIG. 5, the base 32 of the coin path portion 30 of the embodiment of the present invention has an inclination, relative to side wall 36. As a coin (for example small coin X shown in FIG. 5) is dropped into outlet 20, it will fall to portion 30. Under the influence of gravity, it will roll down the incline of portion 30, but the lower periphery of the coin will also slide down the lateral inclination of the base 32, as such a part of a lower peripheral edge of the coin will make point contact on base 32, and will locate between the lower end of base 32 and the lower end of side wall 34. This causes the coin, again under the influence of gravity, to fall to the position shown in FIG. 5, where the top peripheral edges makes a point contact with side wall 36 of coin path 26. Successive coins passing through area 38 on coin path 26, will each adopt an orientation where point contact will be made between a peripheral edge and wall 36, and a peripheral edge and base 32. This orientation is more stable and thus more reproducible in successive coins passing through region 38.

Coin Y, being a larger-diameter coin, will have a slightly different rest angle to that of coin X, but the angle is substantially the same for all coins. This has been found to assist in accurate validation, different coins may adopt different orientations at the area 38 of interrogation (to be described hereinafter) through rattling or wobbling as they pass the area, or as a result of the coins being wet or sticky, which leads to a reduction in accurate discrimination.

Located on respective sides of coin path 26 at area 38 is one set of inductive (pot) coils 40,42. Coils 40,42 are connected in a detect circuit (such as, for example, the circuit of FIG. 11) and form a singular inductive field. The coils (40,42) are adapted to be energised with a single pulse, for each coin validation operation, by a generally conventional switching circuit (not shown).

The coils 40,42 are physically connected to respective body portions 14,16 preferably with an adhesive. From FIG. 5 it can be seen that the coils 40,42 are located generally parallel to the plan of coin path 26, and as near as practicable are separated by about the coin path width W.

Figure 7:
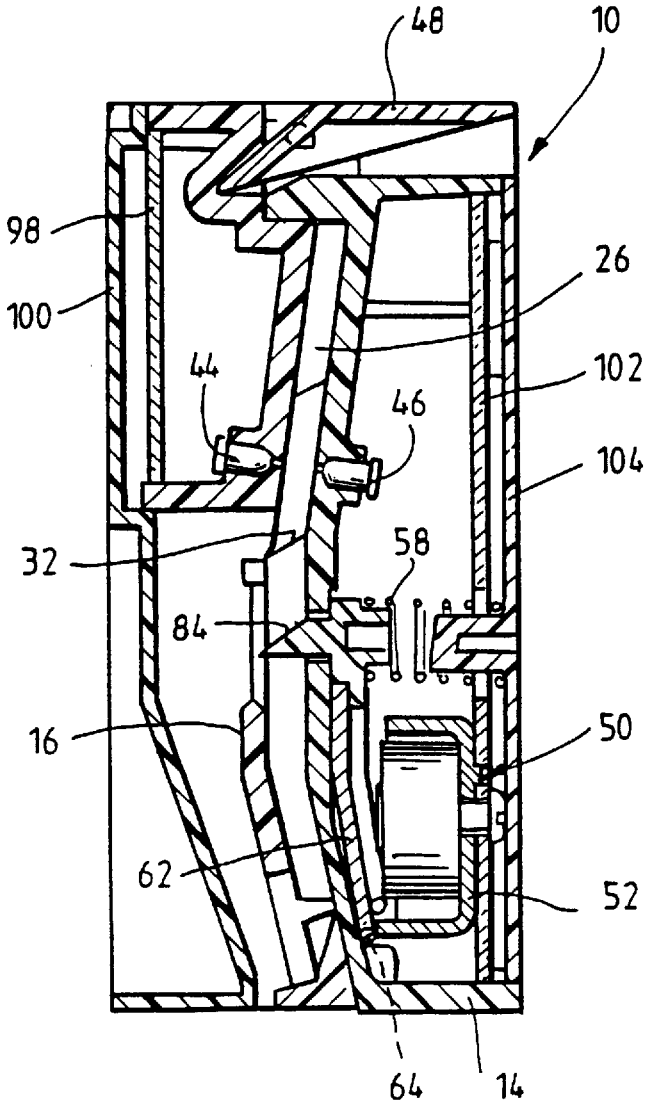
FIG. 7 is a section along the lines 7—7 of FIG. 6.

Located just adjacent to coils 40,42 in a position on the edge of the detect area 38, is a pair of optical sensors 44,46 (FIGS. 4, 6 and 7).

In FIG. 7 there is also shown a reject lever 48, which may be pushed down to release a jammed coin entering coin path 26.

Figure 8:
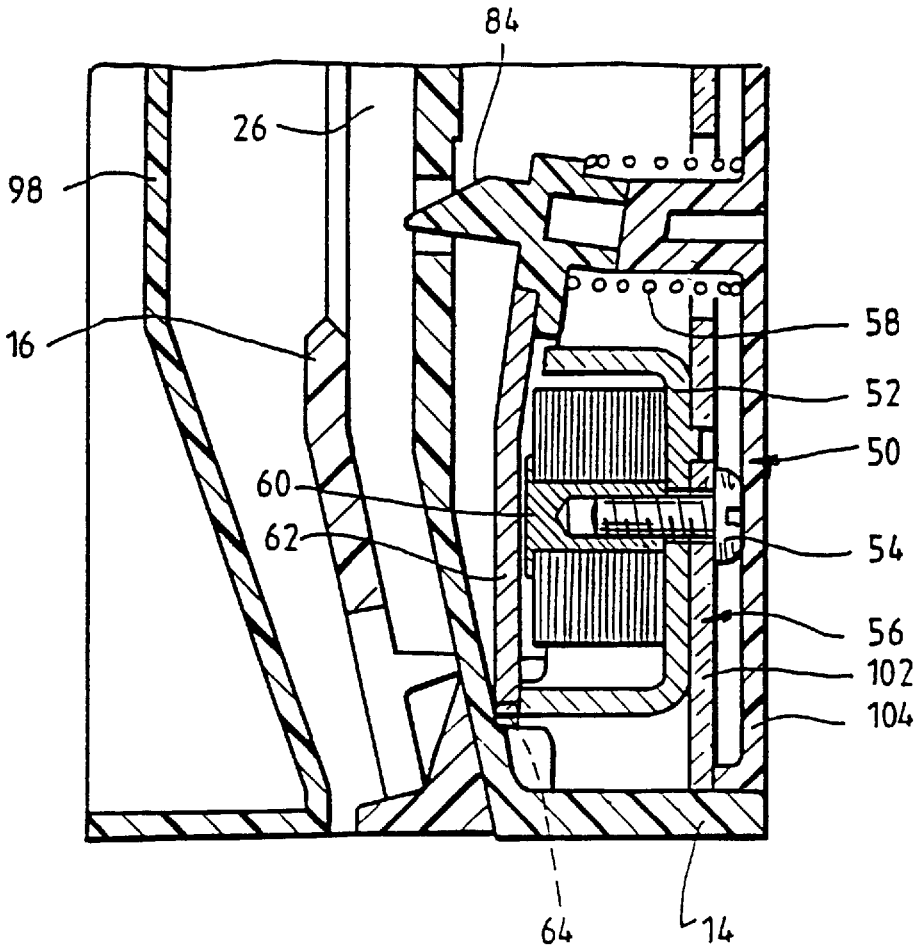
FIG. 8 is an enlarged view of part of FIG. 7.

Located at the base of body portion 14 is a coin accept/reject mechanism 50, shown in more detail in FIG. 8.

The mechanism 50 provides a fast acting means for allowing an accepted, that is, a validated coin to move into an 'accept' channel, whilst preventing a rejected coin from passing into the accept channel. The rejected coin is diverted into a 'reject' channel.

The mechanism 50 includes an accept/reject arm 62 which is pivoted on a 'floating' pivot 64, to be activated by a solenoid which has a U-shaped electro magnet 52 secured to body portion 14 by a screw or the like 54. The floating pivot 64 is adapted for limited movement, for example, it may be located in a groove in portion 14, to facilitate rapid movement of arm 62 between positions.

Arm 62 is normally held by spring means 58 in the 'reject' position shown in FIG. 7, where surface 84 of the arm 62 constitutes a continuation of base 32 of coin path 26.

When the mechanism is provided with an 'accept' signal, instruction or the like, the solenoid is energised. This causes arm 62 to be attracted to magnet 52. In particular, pivot 64 is attracted to the lower portion of magnet 52, eventually making contact therewith. At that stage the magnet 52/arm 62 combination enables more magnetic flux to be generated, and thus more magnetic force is applied to arm 62, to move it more quickly to the FIG. 8 position. It has been found that such an arrangement as the one shown in FIG. 8 enables extremely rapid retraction of arm 62.

The paths of both accepted and rejected coins will now be described in relation to FIGS. 1 to 10; they are best represented visually in FIG. 10.

Figure 9:
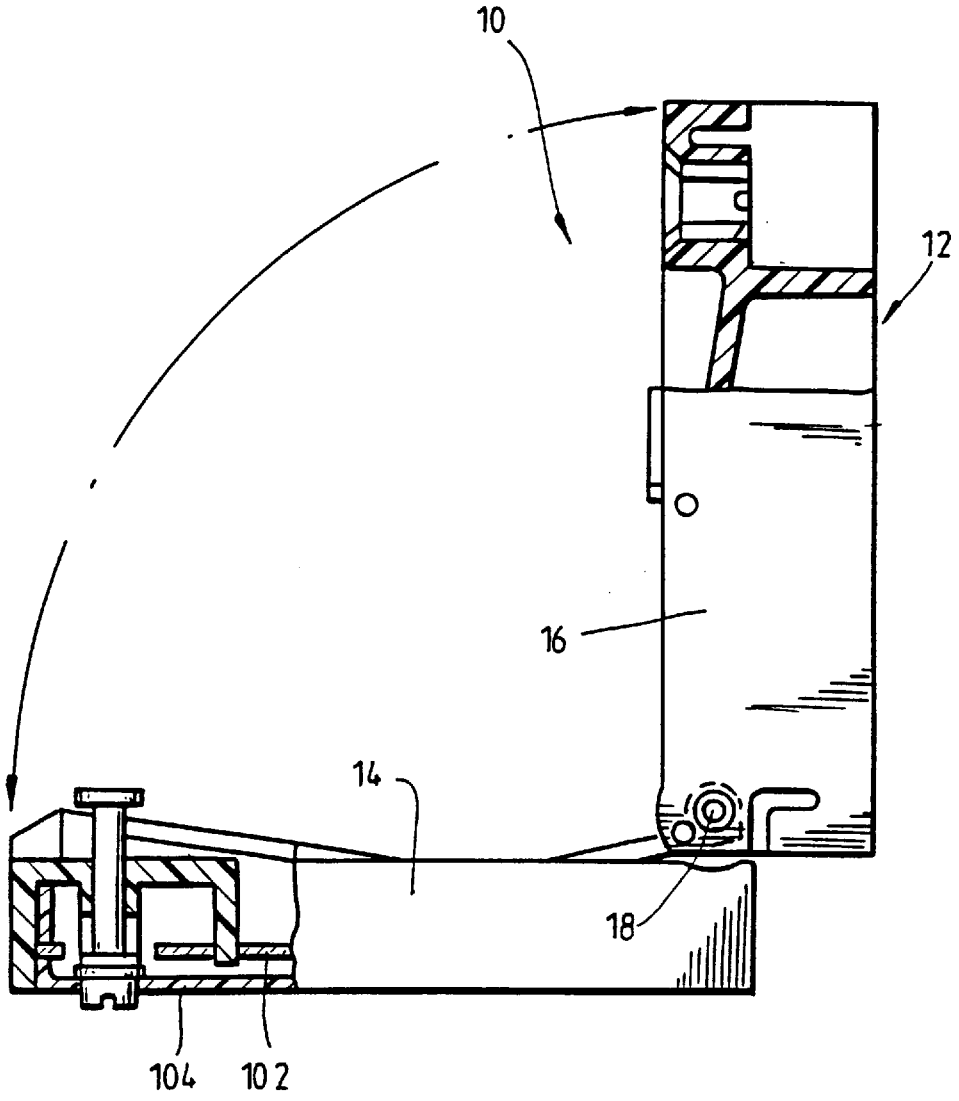
FIG. 9 is a section along the lines 9—9 of FIG. 6.

FIG. 9 shows the body 12 of validator 10 in its open configuration, where body portions 14, 16 have been pivoted apart at pivot points 18. Pivot point 18 is preferably constituted by two hinge pins located at either end of the body 12, generally on the line of the coin path 26.

The body portions 14, 16 and covers 98,102 are produced from a plastics material by injection moulding, and the coin path 26 is defined by internal mouldings of the portions. Thus, the one 'wall' of the coin path 26 is formed on one portion, and the other 'wall' on the other portion.

The hinged body arrangement, best shown in FIG. 9, enables the two portions 14,16 to be pivoted apart. The two portions are biased together, by spring means or the like—in order that the coin path 26 may be cleaned. Coin paths in validators often become dirty and/or clogged, due to residues carried by coins which pass therethrough.

Furthermore, the portions 14 and 16 are pivoted apart in order that bent coins or slugs stuck in the device are able to drop free into the reject path.

The covers 98,102 fitted to body portions 14,16 also provide splash and dirt protection for the electronic components.

Figure 10:
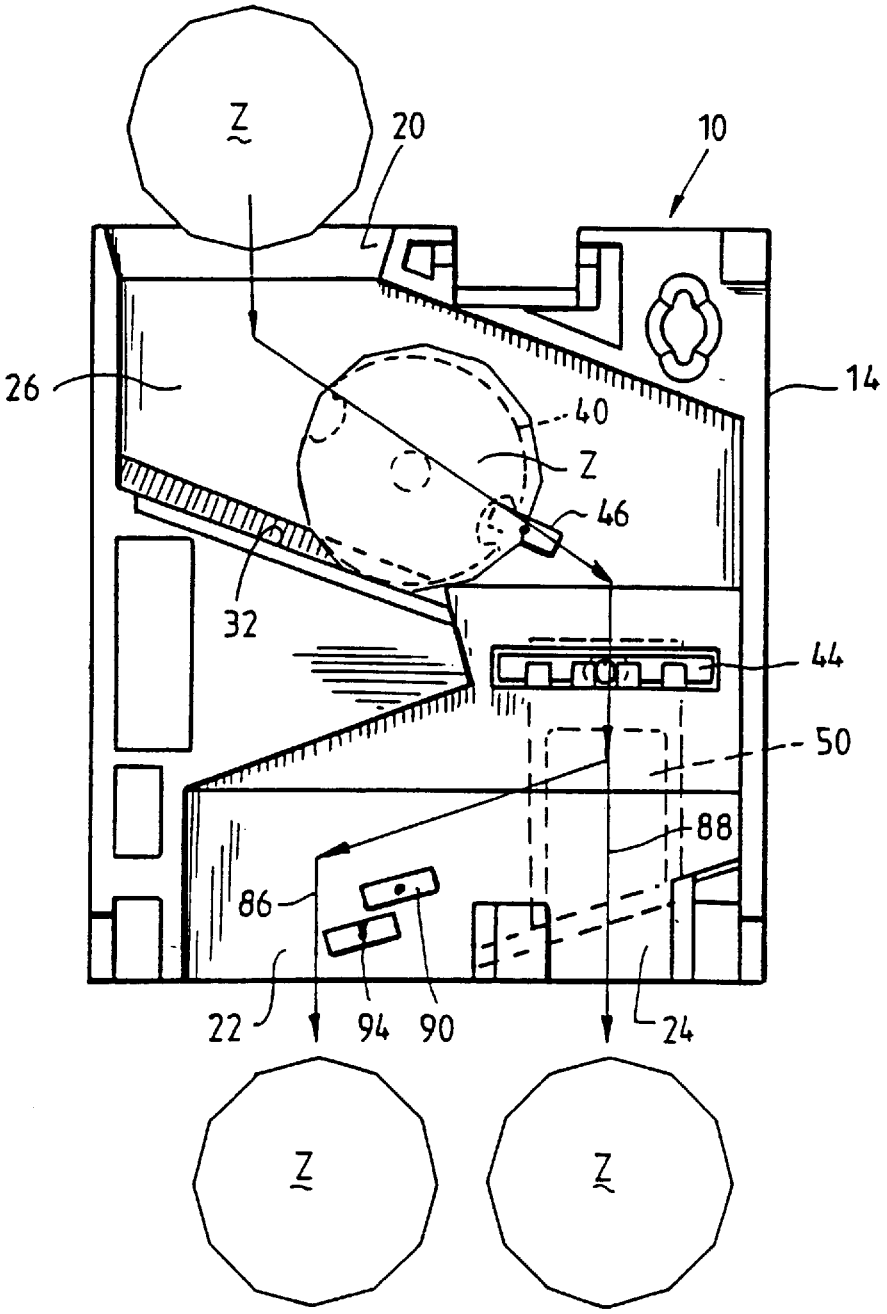
FIG. 10 is a section along the lines 10—10 of FIG. 1.

A coin Z—in the representation of FIG. 10, an Australian fifty-cent coin—enters validator 10 through inlet 20. There is in use, a coin channel leading from outside a vending machine, for example, to inlet 20, through which the coin Z may initially have to pass.

Figure 36:
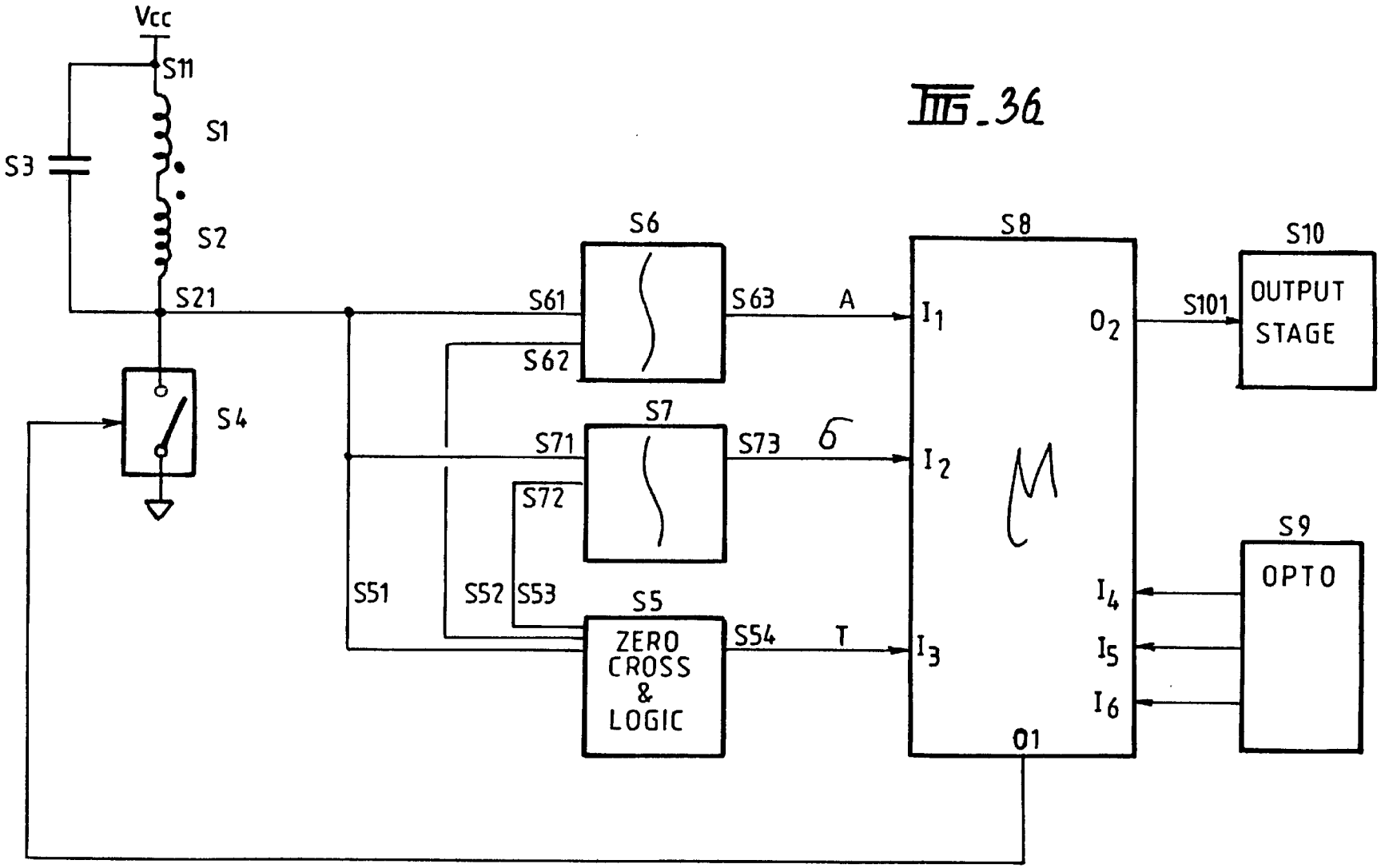
FIGS. 36 is a circuit diagram illustrating one embodiment used to conduct the discrimination of the present invention.

When the coin Z reaches the position shown, in which it is between coils 40 and 42, (S1,S2 of FIG. 36) (see also FIG. 5, where coins X, Y are shown in that position) the presence of coin Z will be detected by optical sensors 44,46 (S9 FIG. 36).

A 'coin detected' signal from sensors S9 FIG. 36 44,46 is sent to a microprocessor S8 FIG. 36 which causes coils 40,42 (S1,S2 FIG. 36) to be energised with a single pulse. After analysing the results of that energisation or pulse, the microprocessor either sends or does not send an 'accept' signal to mechanism 50 (S10 FIG. 36).

If an 'accept' signal is sent to mechanism 50, the solenoid will be energised, arm 62 will be retracted, and coin Z will pass along the 'accept' channel, marked by the arrowed line 86.

If the analysis rejects the coin, arm 62 will stay in the 'reject' position and coin Z will be deflected by surface 84 of arm 62 into the 'reject' channel shown by arrowed line 88.

Two further pairs of optical sensors are provided. They are check optical sensors 90,92 and accept optical sensors 94,96 (S9 FIG. 36).

If coin Z is accepted, and keeps moving down the accept channel, it will first pass between check sensors 90, 92. Both the check and accept optical sensors are continuously monitored by the aforementioned microprocessor so as to ascertain the direction of movement of a coin within the validator 10. If the passage of the coin Z is such so as to trigger the accept optical sensors (90,92) before triggering the check optical sensors (94,96) then the passage of the coin Z is considered to be fraudulent and an alarm signal is generated or alternatively no outputs will be generated. This applies in cases where a coin on a piece of string or twine or other device is pulled in and out of the validator in an attempt to create fake credits.

The coin continues down the accept path until it reaches the accept optical sensors (92). Upon triggering the accept optical sensor the microprocessor considers that the coin Z has successfully travelled through the device and will give the appropriate outputs.

The approach of the present invention to coin validation/discrimination data used in the validator 10 of FIGS. 1 to 10, will now be described.

Figure 11:
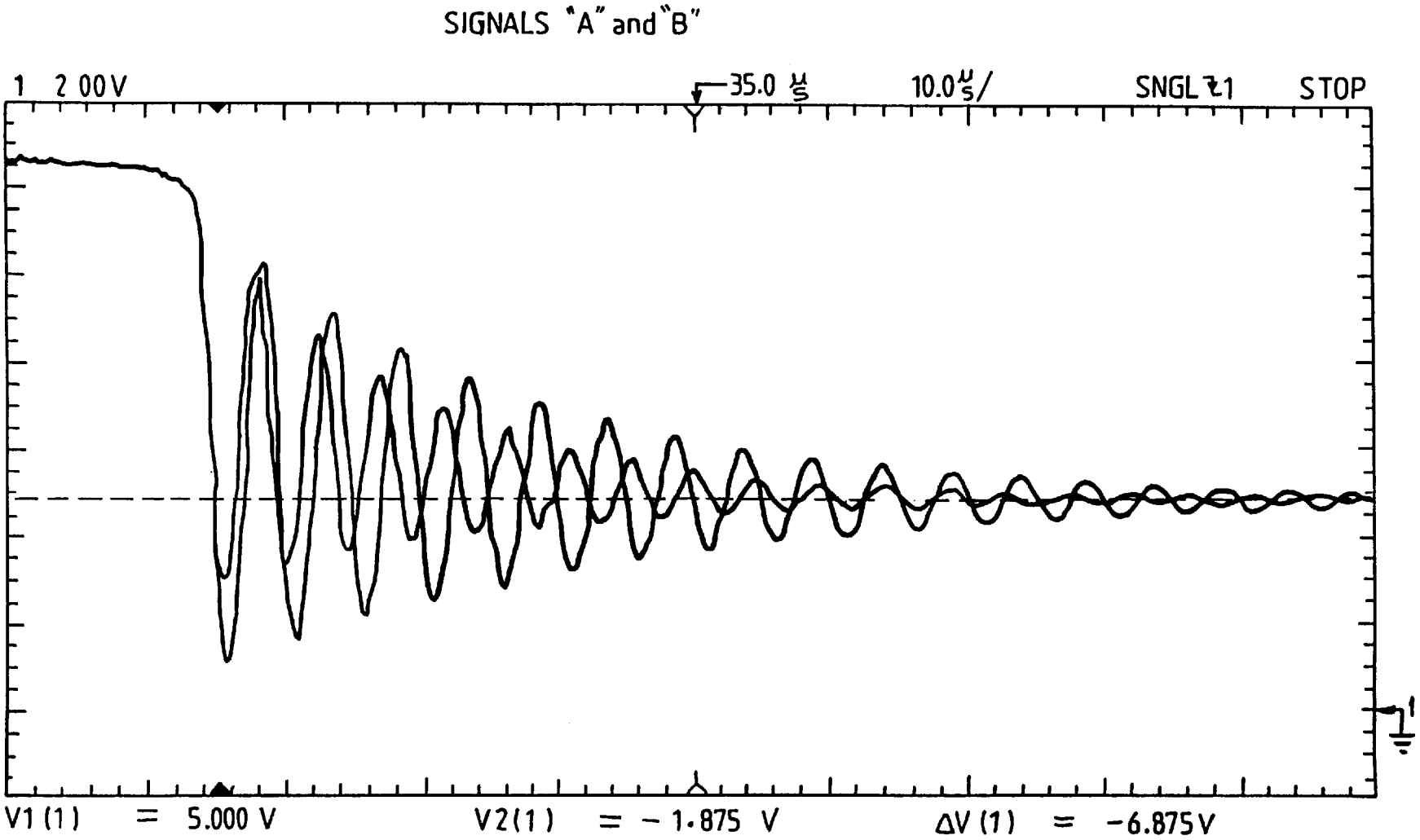
FIG. 11 is a non dampened back emf oscillating waveforms of two coins A and B.

In FIG. 11 the unmodified back emf oscillating waveforms of 2 coins (A and B) are given and superimposed one on top of the other. These two different coins were selected because of their close characteristics which makes them difficult to differentiate using current discrimination systems.

Modification of these back emf oscillating waveforms by known means such as inversion and amplification have tended to eliminate distinguishing features between them, though of course, allowing ready discrimination with other types of coins with clearly different characteristics.

As will be readily apparent from FIG. 11, the superimposed oscillating waveforms whilst initially very similar, display significantly different amplitude and frequency after a relatively short period of time. By recording these differences for any type of coin it is possible to discriminate even between very similar coins. The recordal can be by any suitable means e.g. devising a resultant analog signal.

Figure 12:
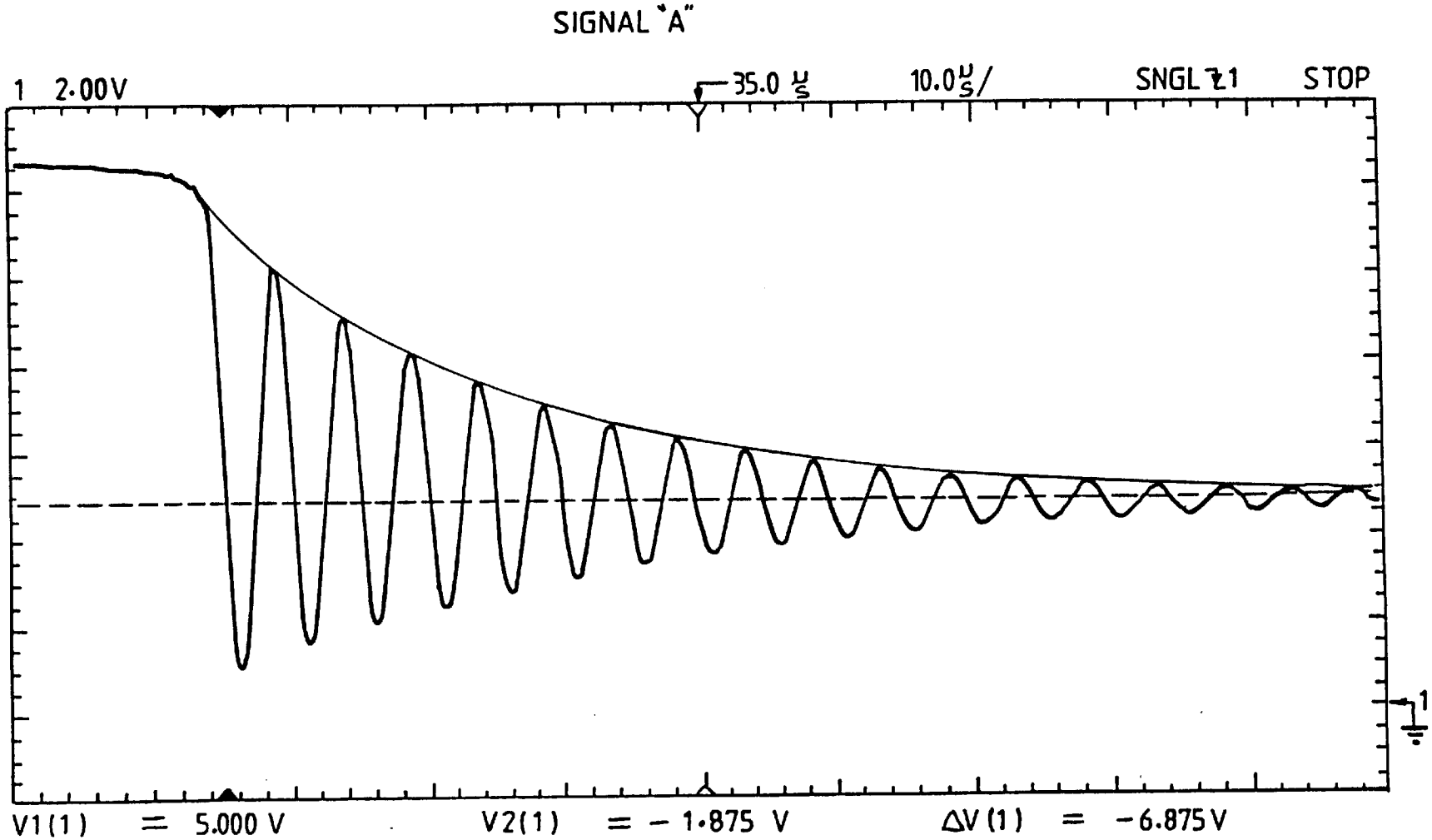
FIG. 12 is a back emf oscillating waveform of coin A of FIG. 11 with an upper mean amplitude curve.
Figure 13:
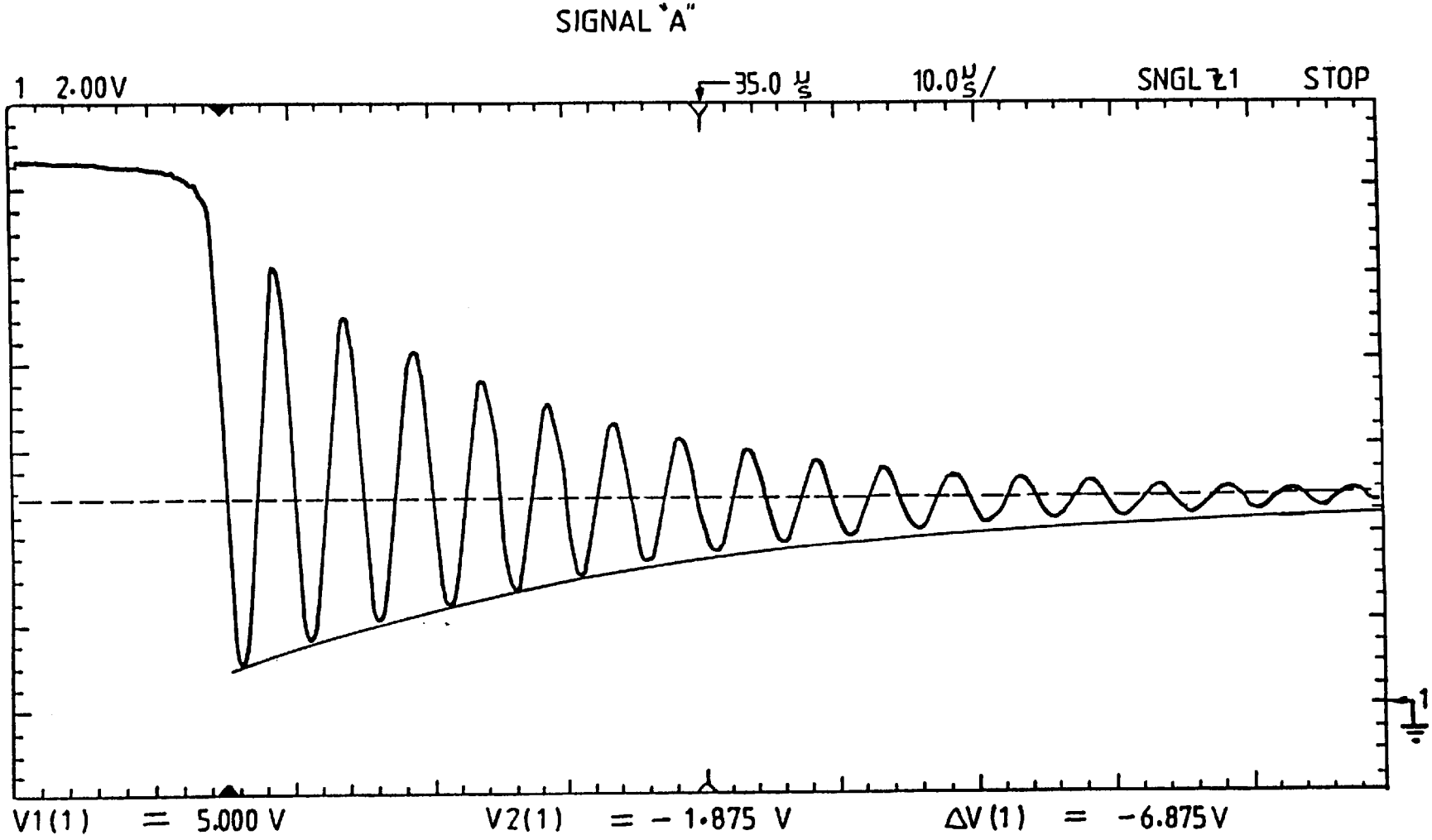
FIG. 13 is the signal of FIG. 12 with a lower mean amplitude curve.
Figure 14:
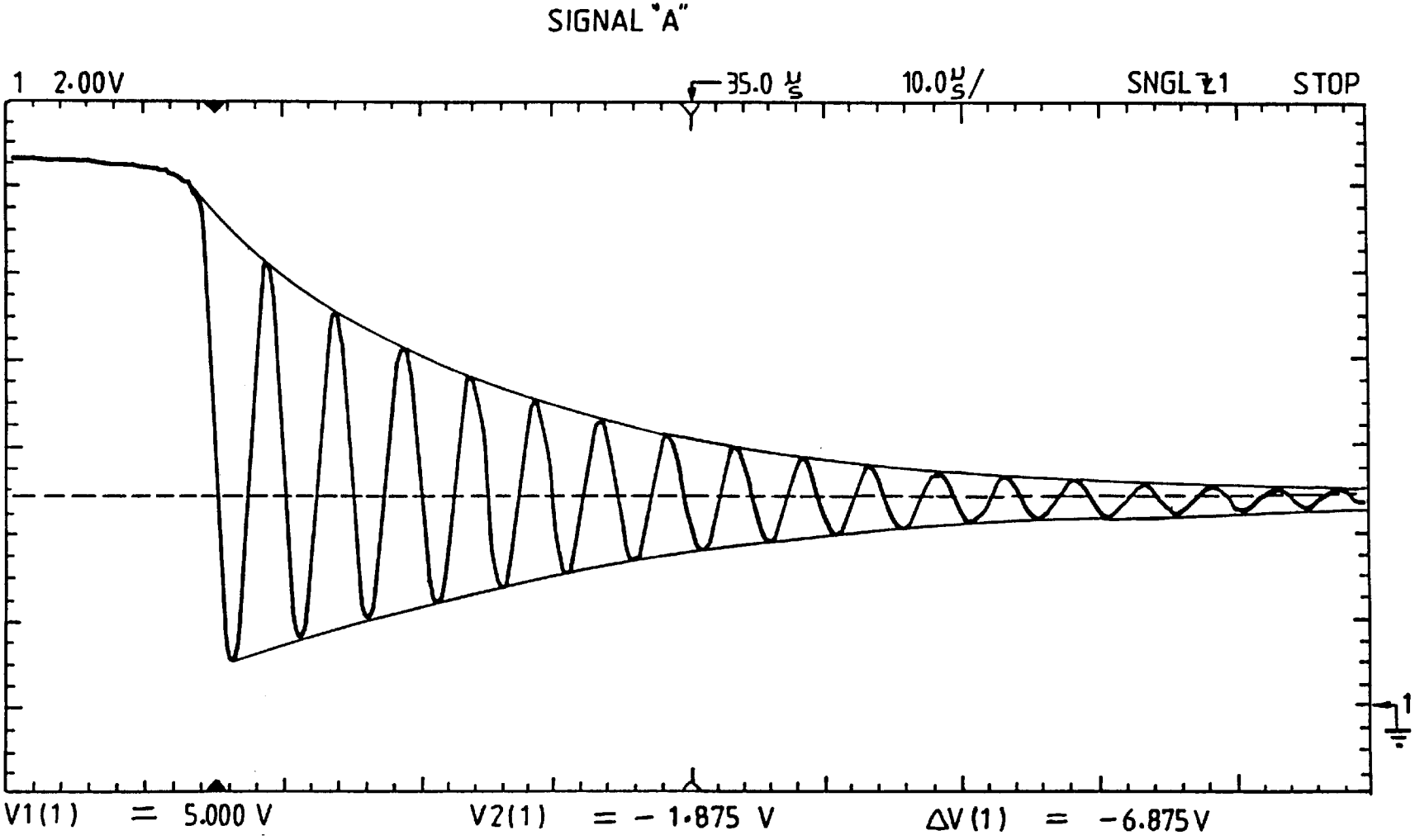
FIG. 14 is the signal of coin A of FIG. 11 with upper and lower mean amplitude curves.

To compare these types of oscillating waveforms it is possible to measure and record various characteristics of the curves. For example such characteristics, or variables include:

(i) superimposing a mean amplitude curve [see FIGS. 12 to 14];

(ii) the phase and/or change in phase of each oscillating waveform;

(iii) (a) the curves plotted by the peaks of either or both of the positive and/or negative portions of the oscillating waveform; and b) the amplitude of the negative and/or positive peaks of each oscillating waveform;

(iv) the area of the curves beneath the peaks of each oscillating waveform;

(v) the frequency and/or change in frequency of each oscillating waveform;

(vi) the decay of peaks of each oscillating waveform in a predetermined time and (vii) any combination of the above.

Some of these approaches are illustrated in FIGS. 12 to 16.

The area of curves beneath the peaks of each oscillating waveform has the advantage of allowing for variations in waveforms due to variations in characteristics of coins of the same denomination. By taking the area beneath the peaks any variations in waveform due to variations in coin characteristics will be allowed for and consistent results obtained.

In FIGS. 12, 13 and 14 the back emf oscillating waveforms of a single coin is shown. Mean curves are drawn on the positive oscillation waveforms amplitudes, negative oscillation waveform amplitudes and both respectively. Typically an analog signal for any of these waveforms can be established to provide a signature for the particular type of coin.

Figure 15:
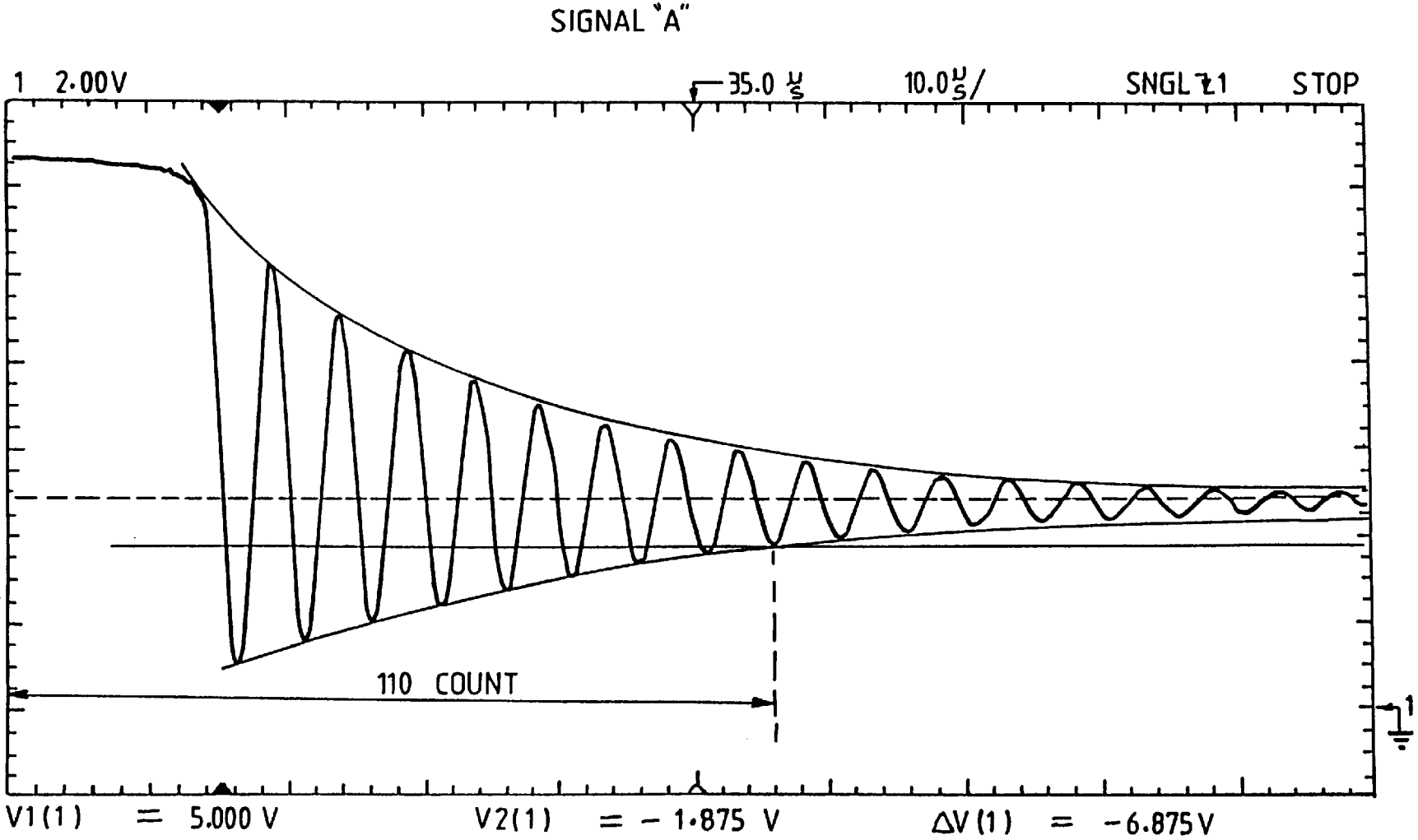
FIG. 15 is the signal of FIG. 14 with measurements after a first clock count.
Figure 16:
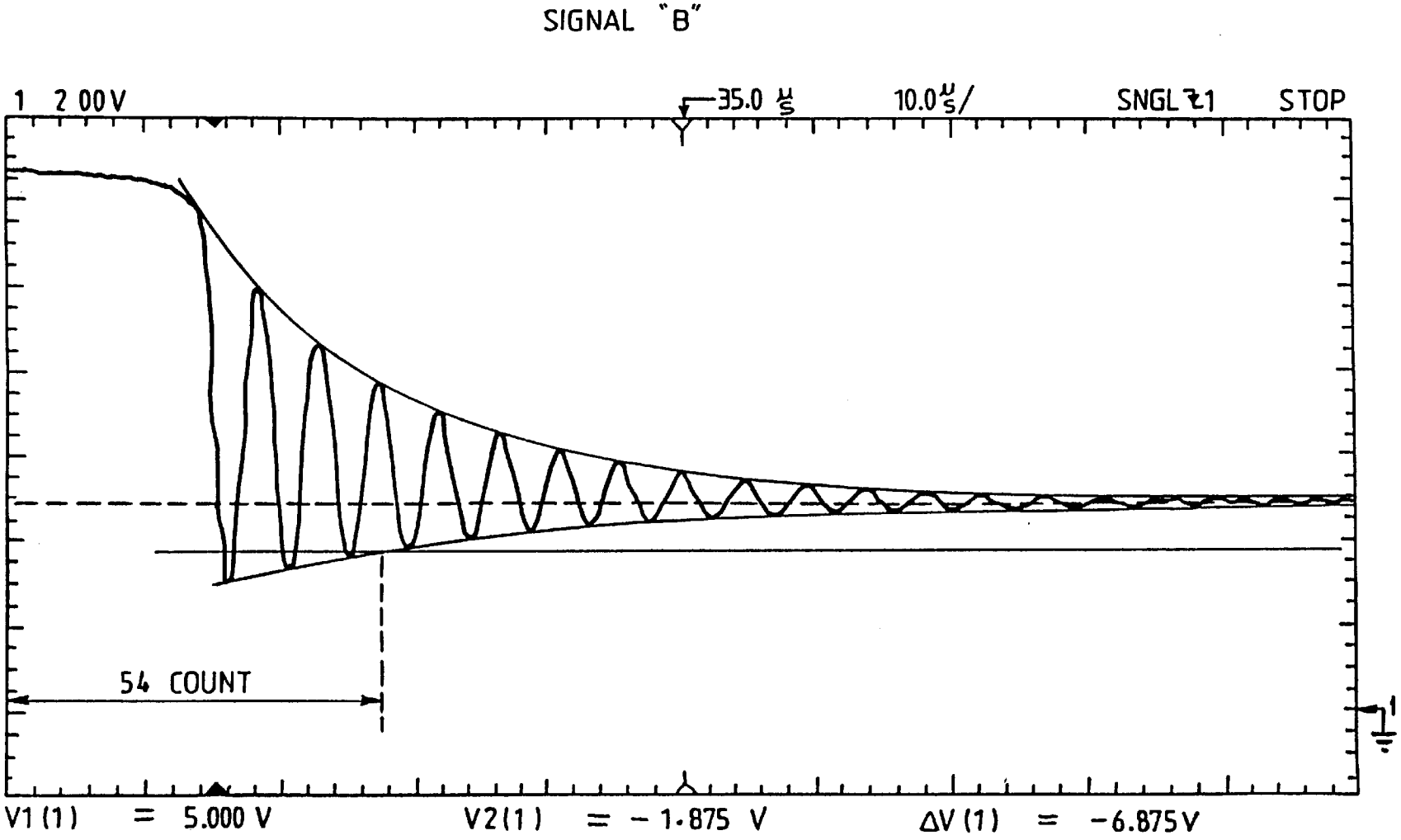
FIG. 16 is a back emf oscillating waveform with mean curves for a further coin.
Figure 17:
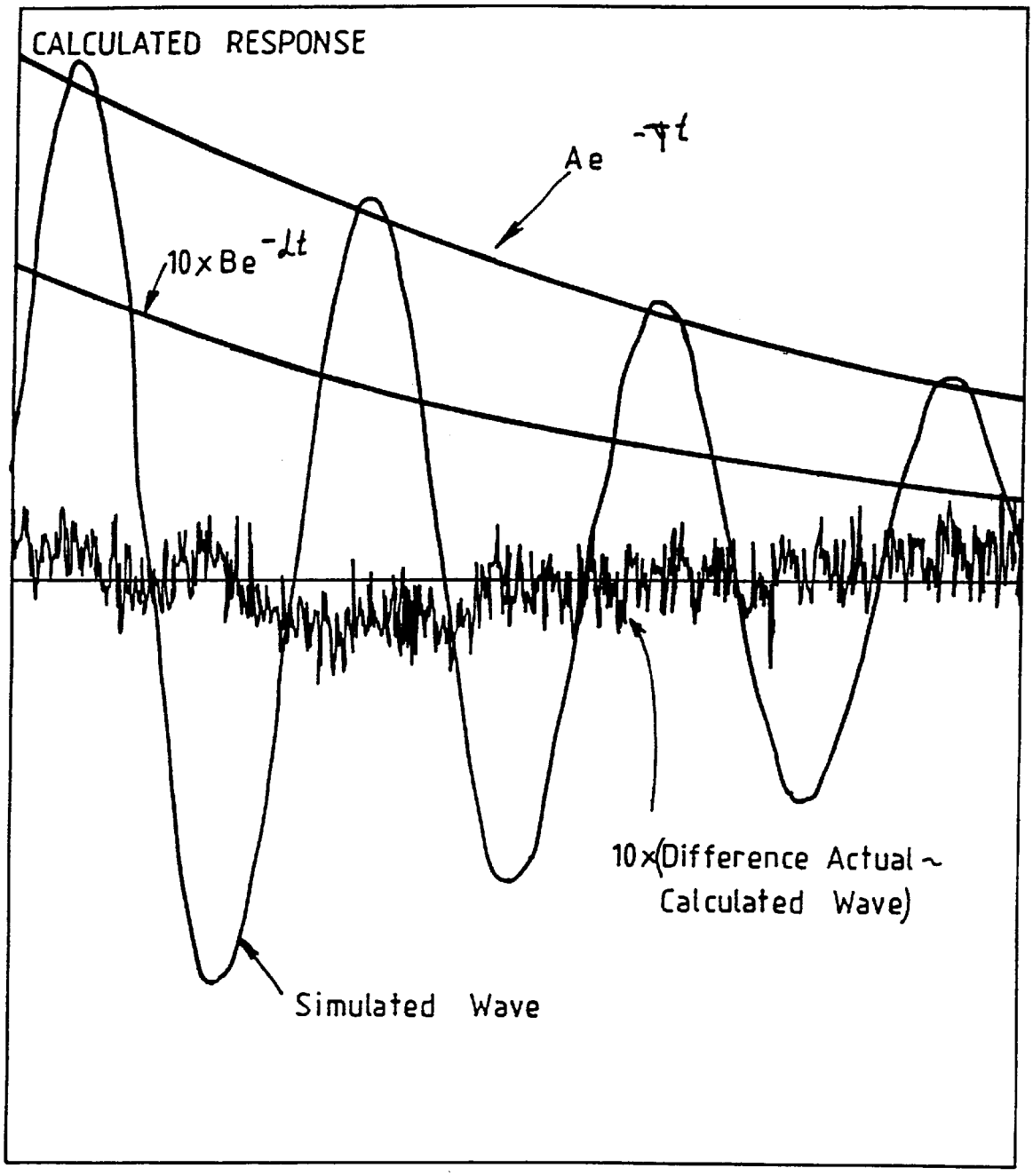
FIGS. 17 to 25 are examples of oscillating waveforms for different coins.
Figure 18:
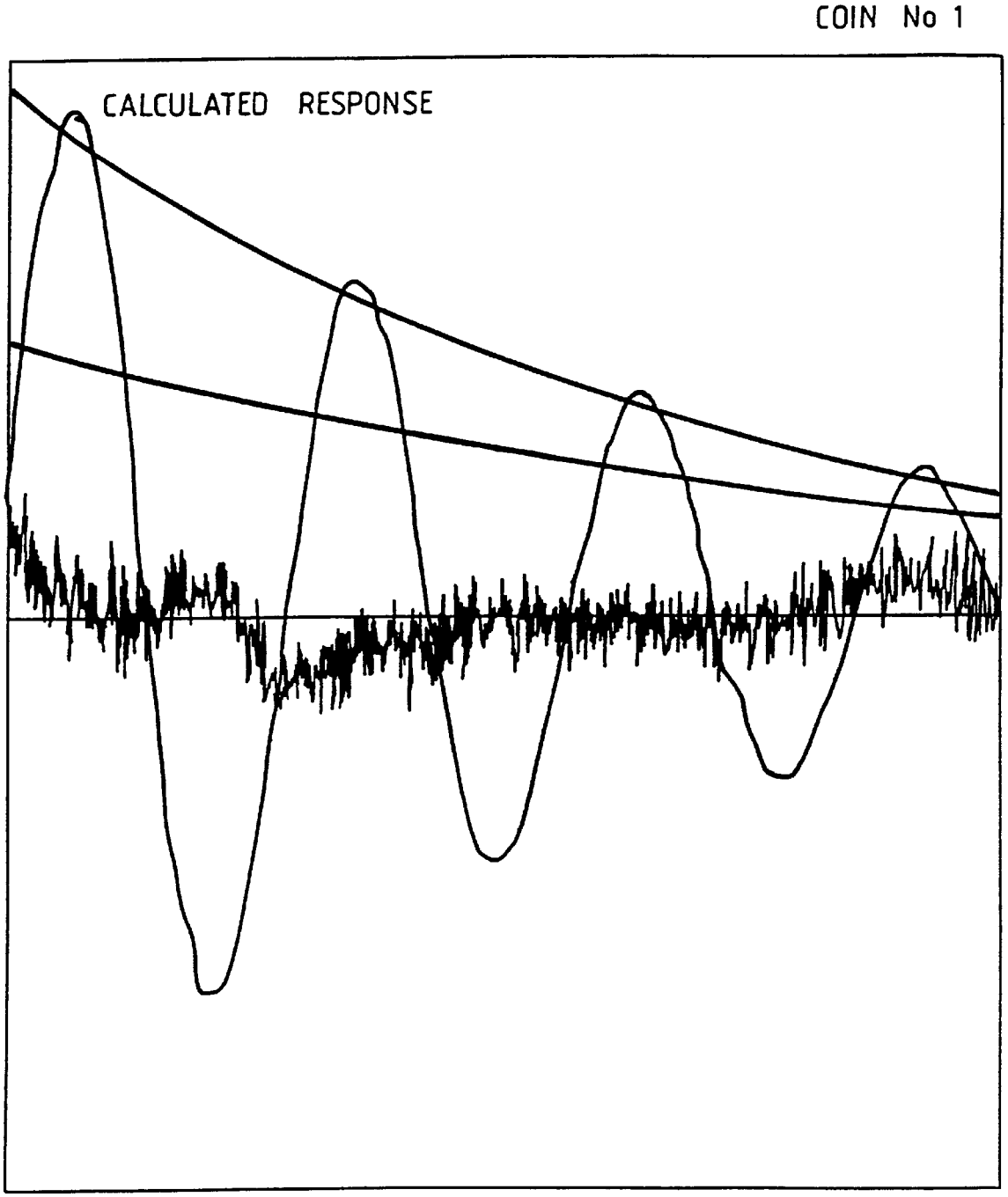
Figure 19:
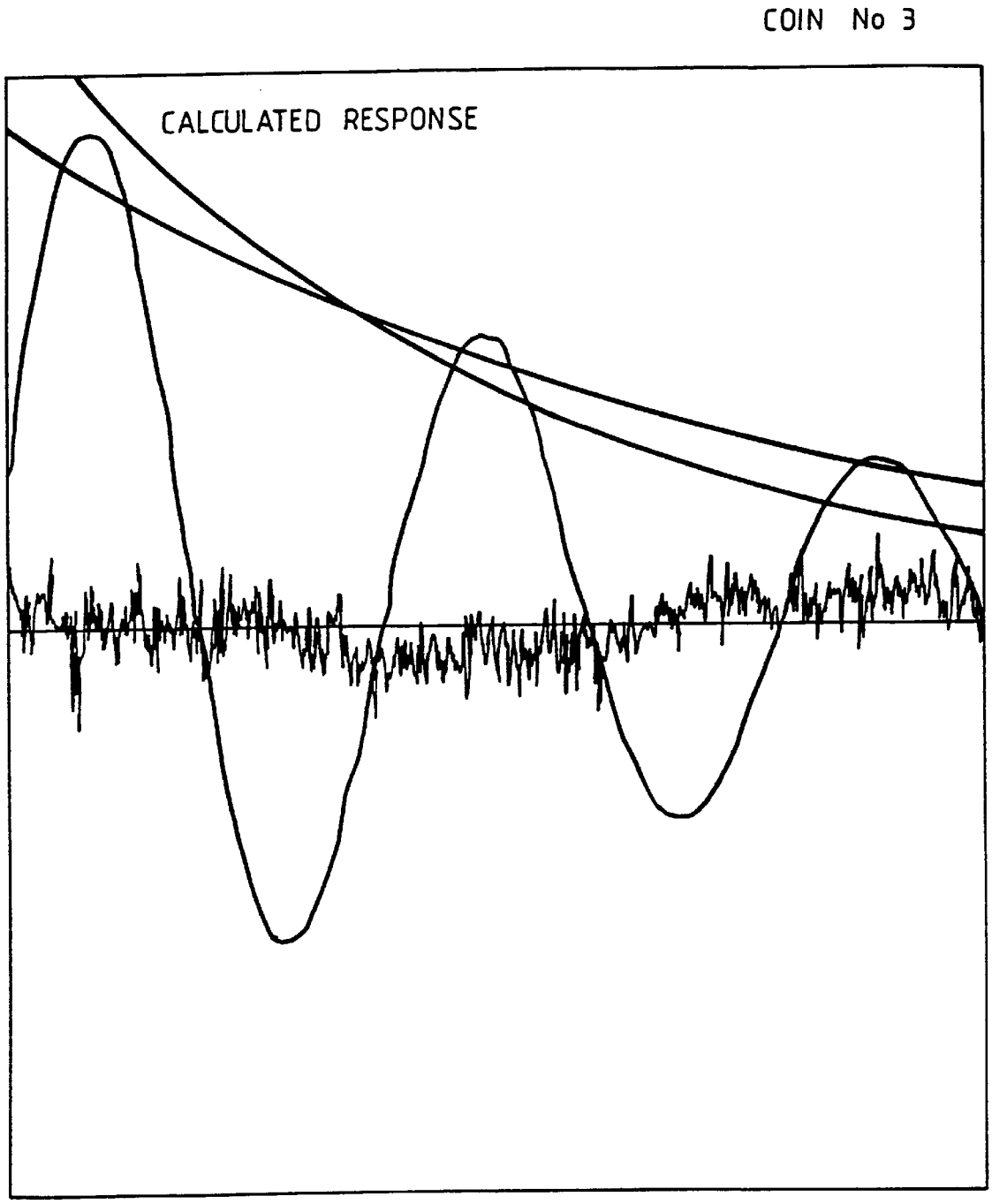
Figure 20:
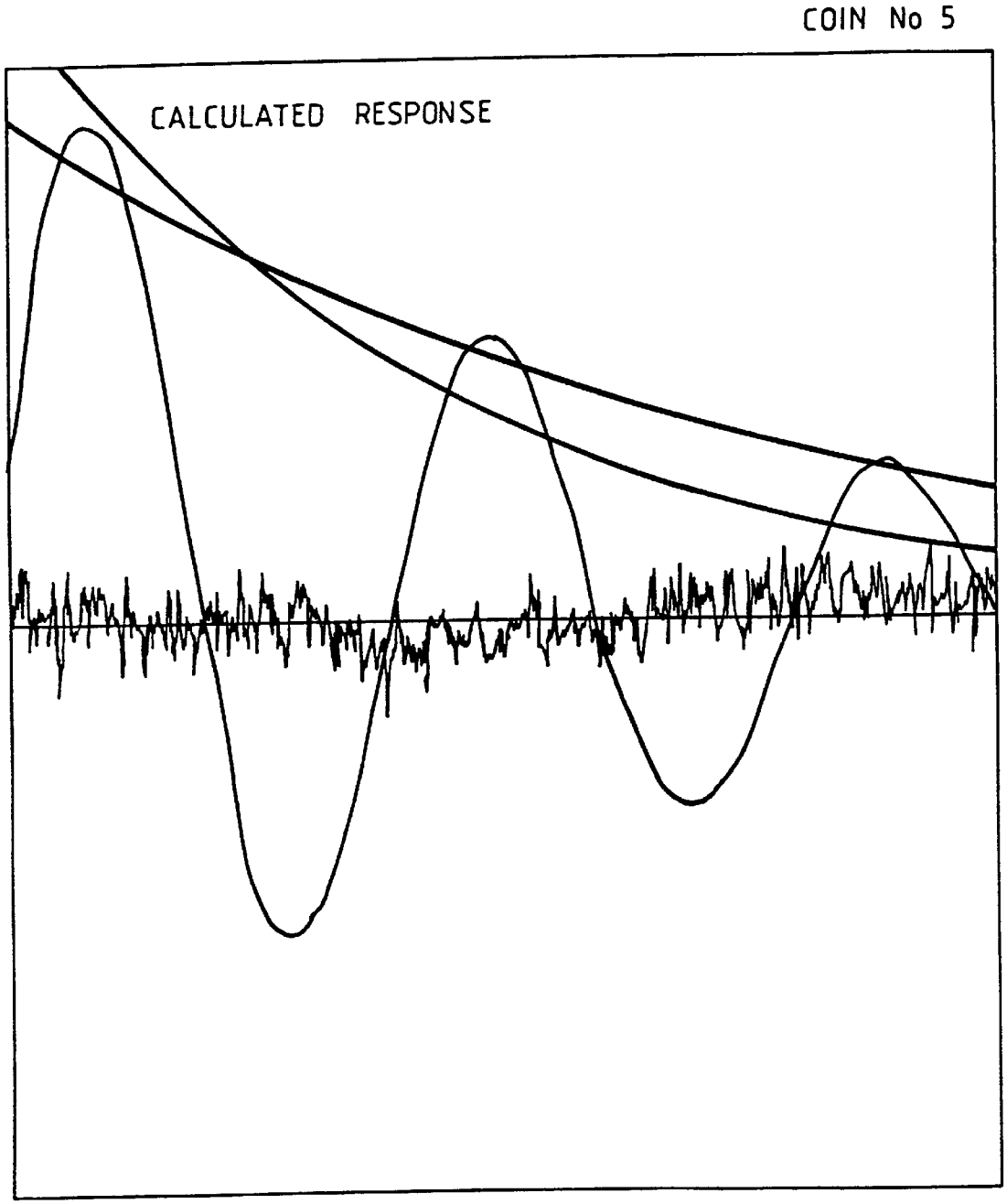
Figure 21:
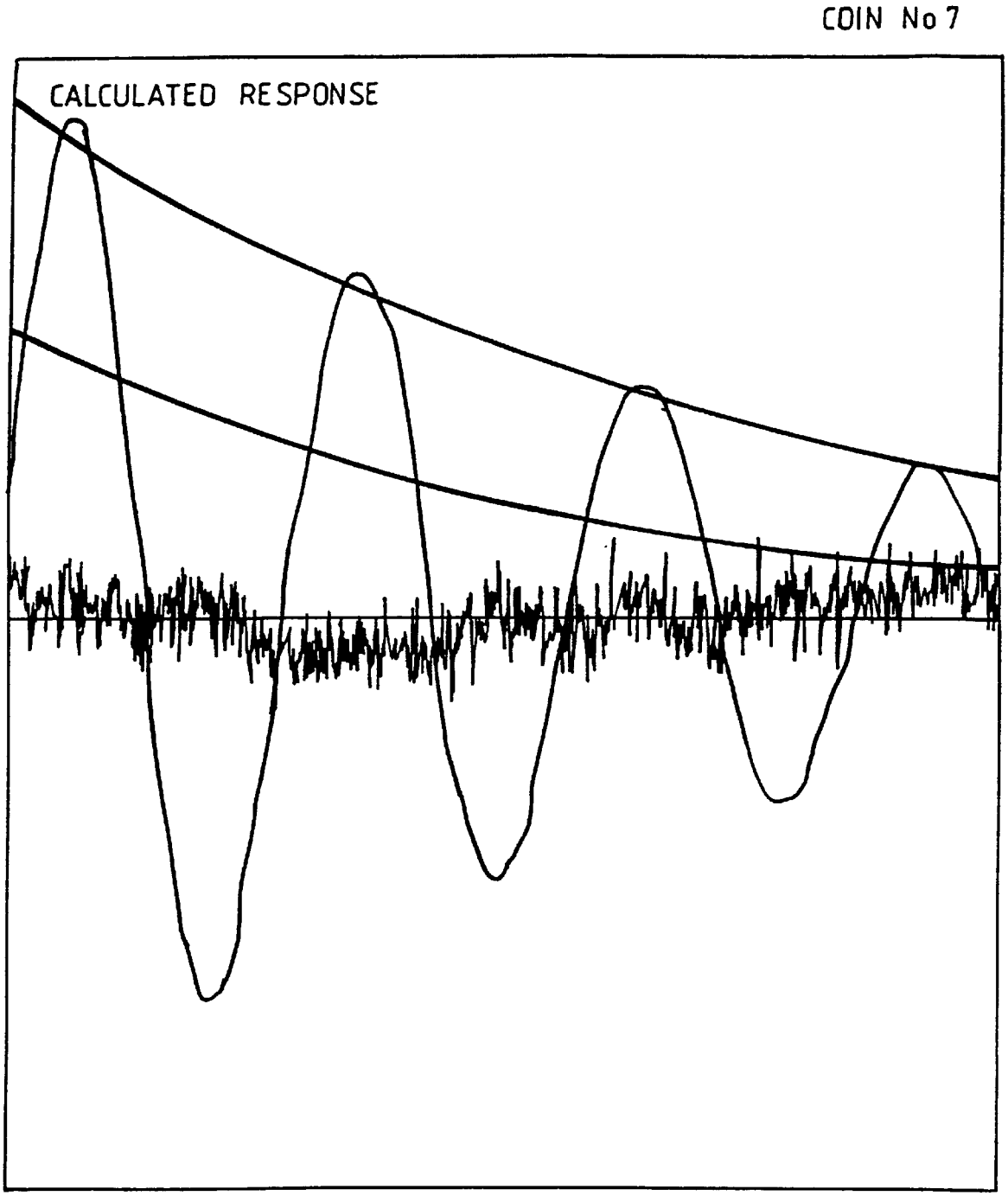
Figure 22:
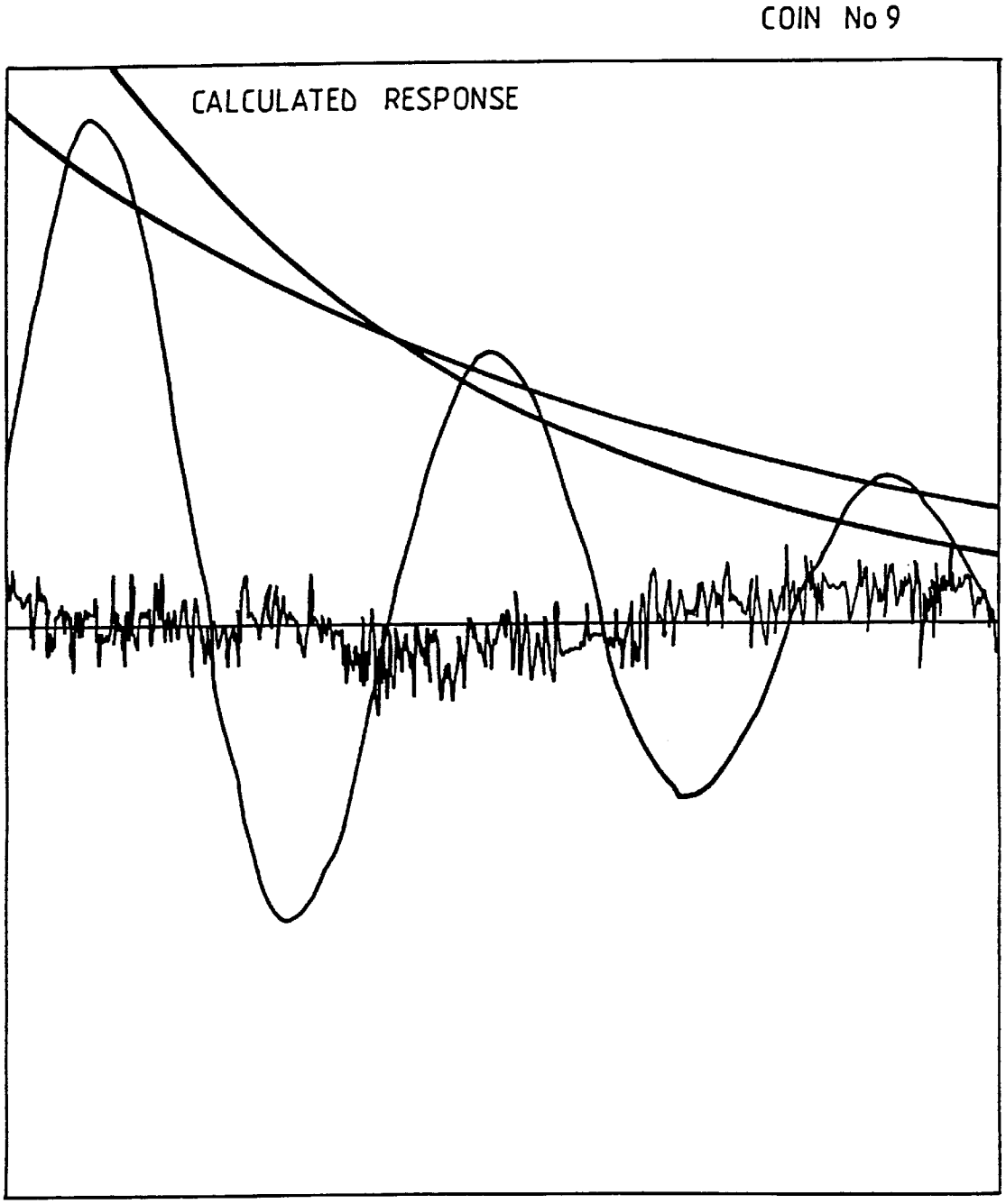
Figure 23:
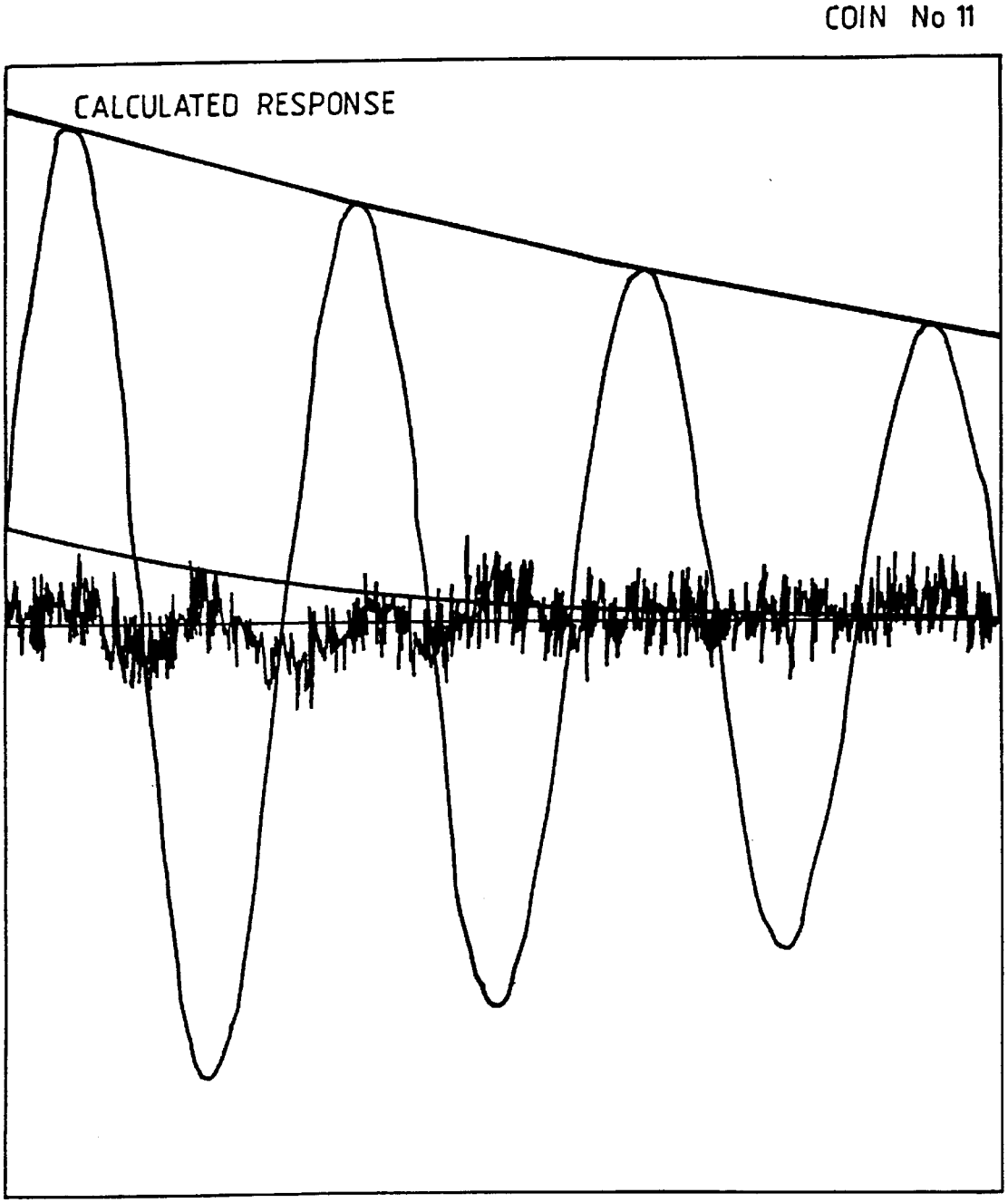
Figure 24:
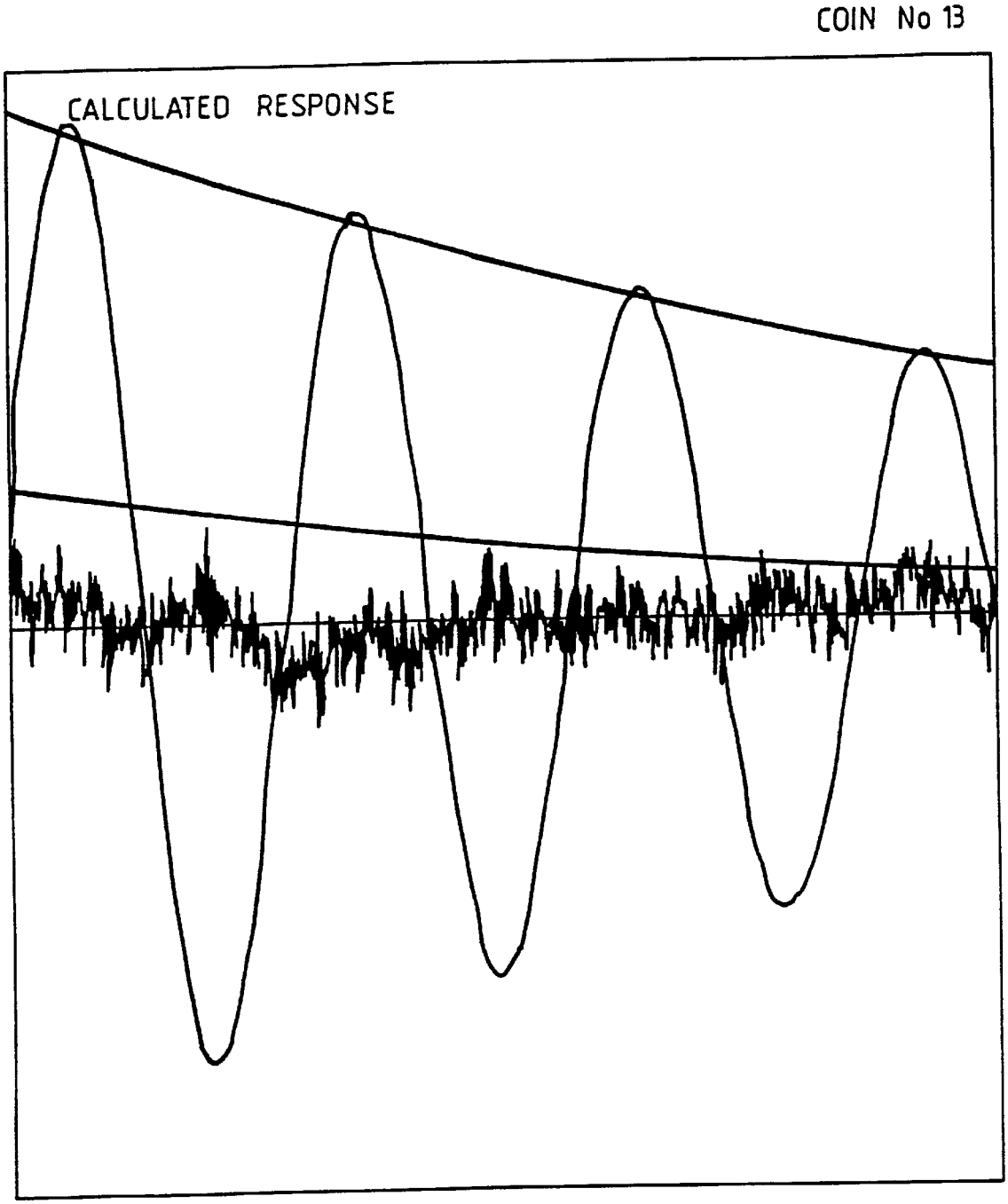
Figure 25:
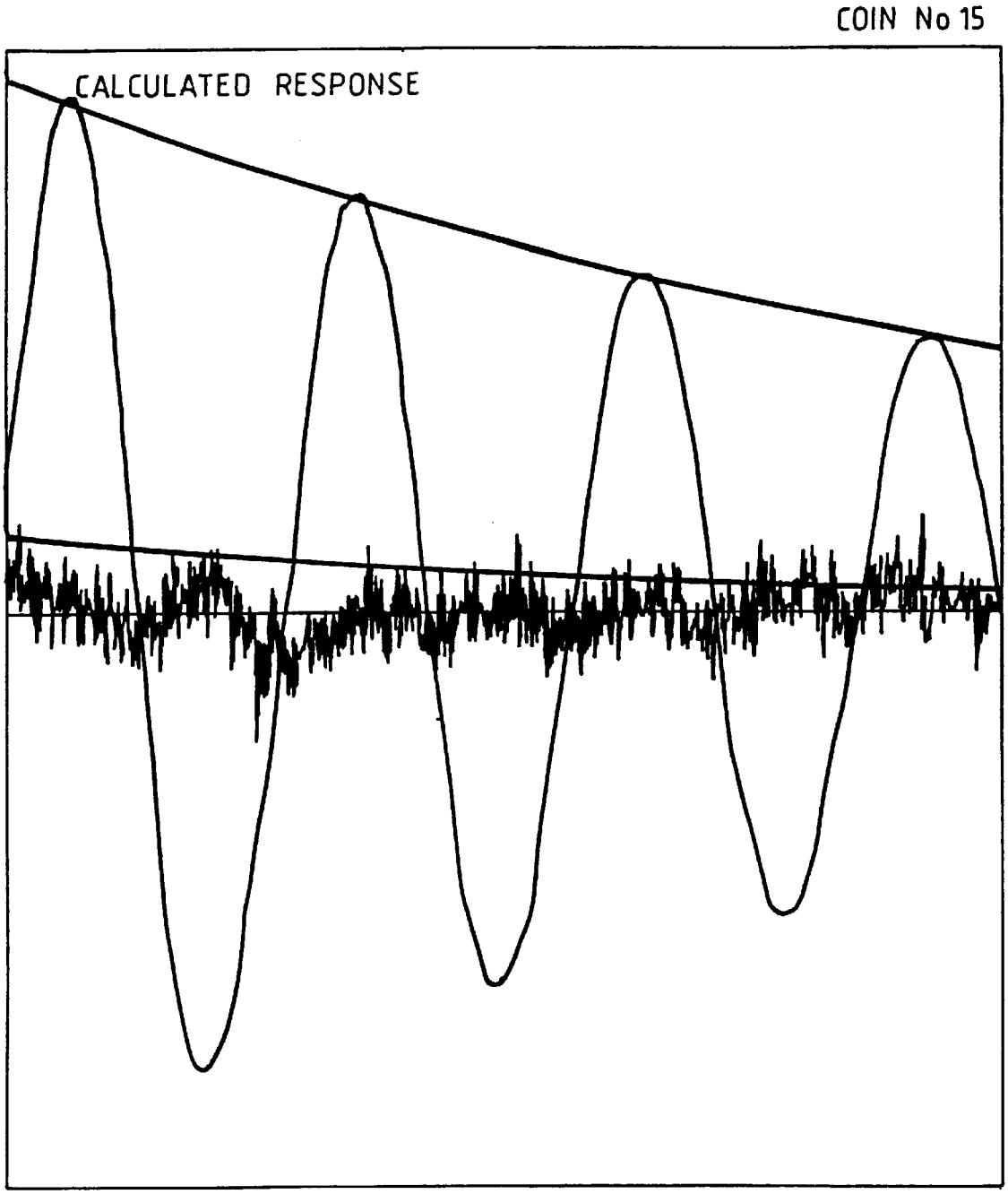
Figure 26:
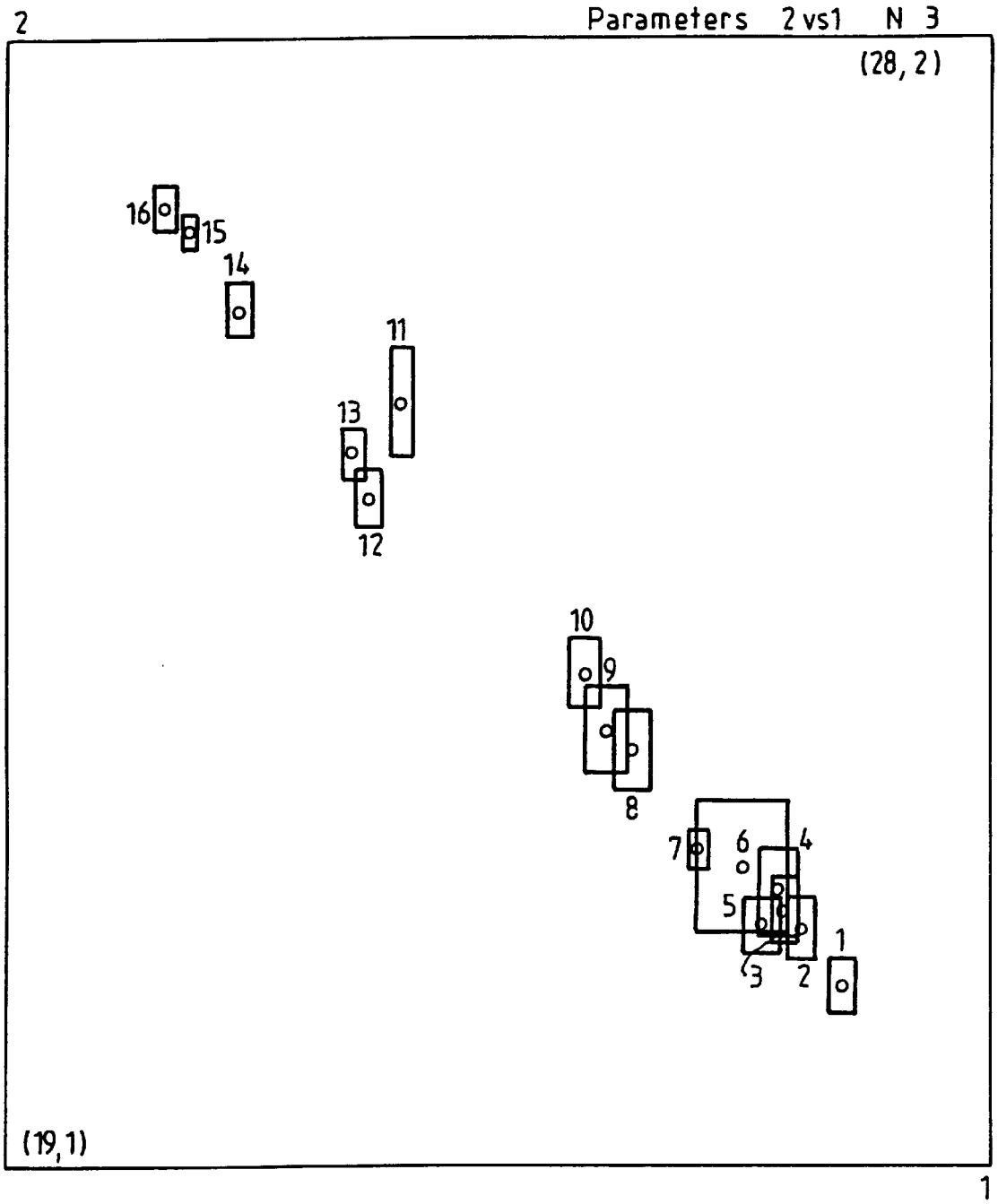
FIGS. 26 to 35 are graphic representations of the ability of the principal variables to distinguish the coin sets of FIGS. 17 to 25.
Figure 27:
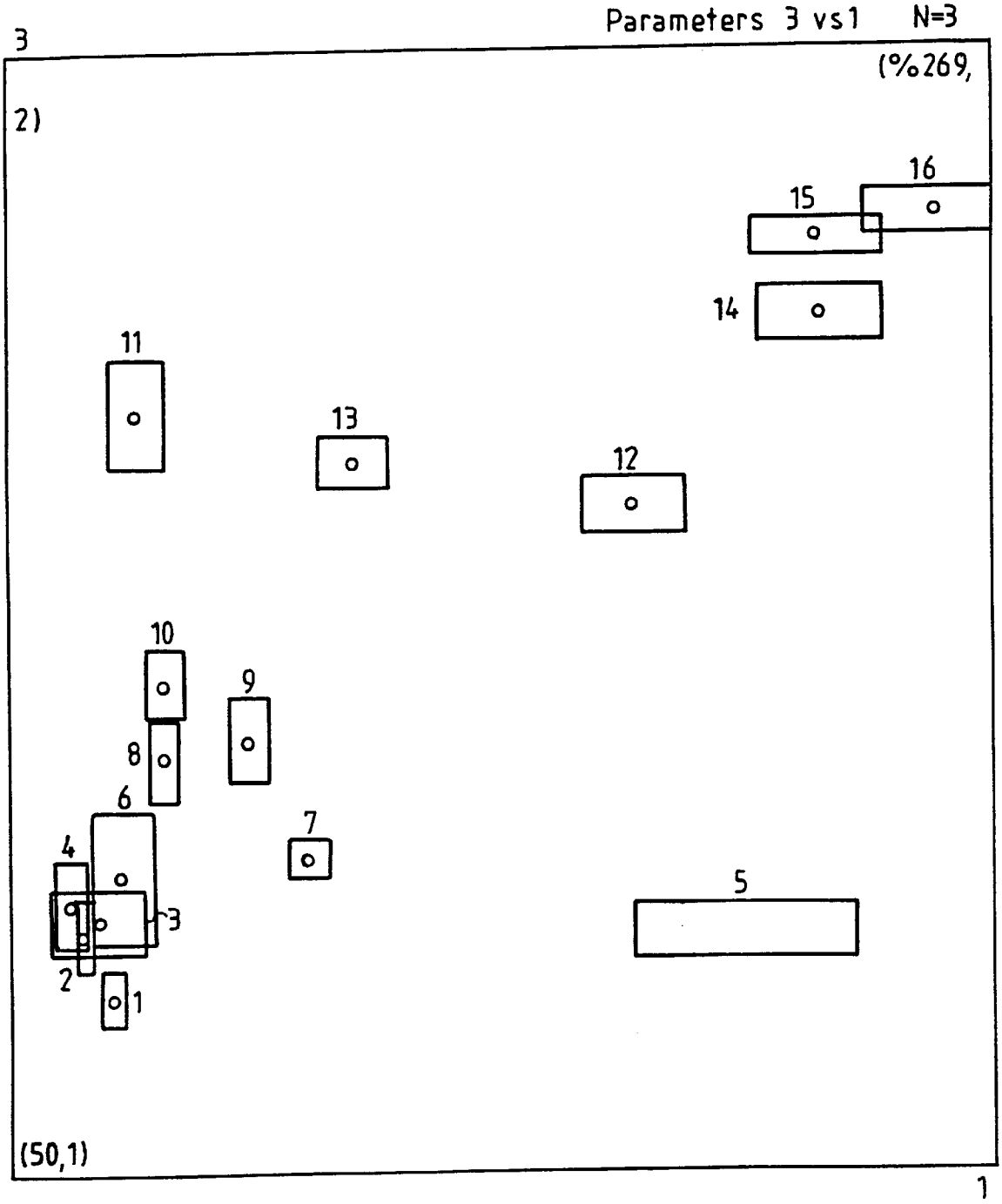
Figure 28:
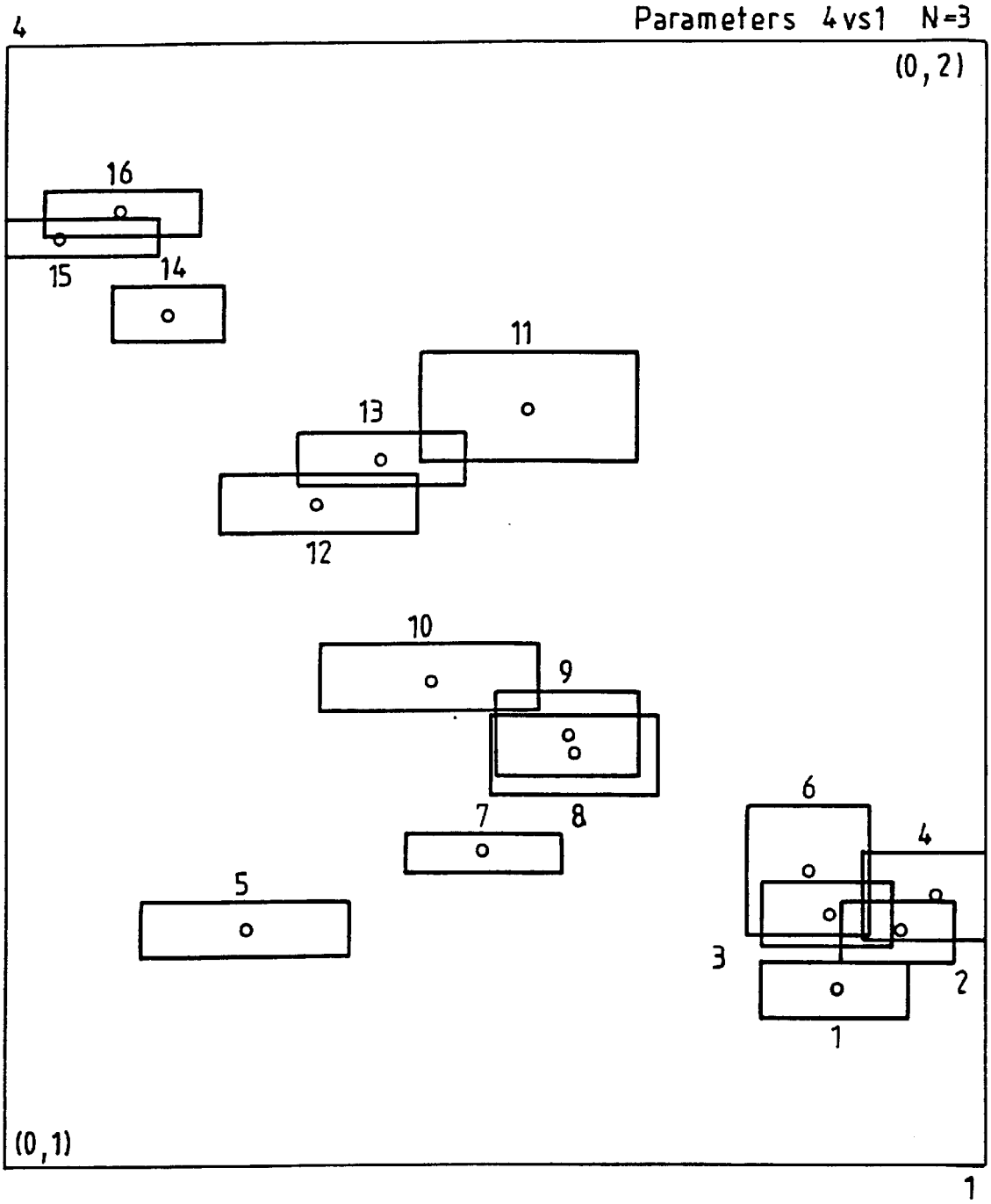
Figure 29:
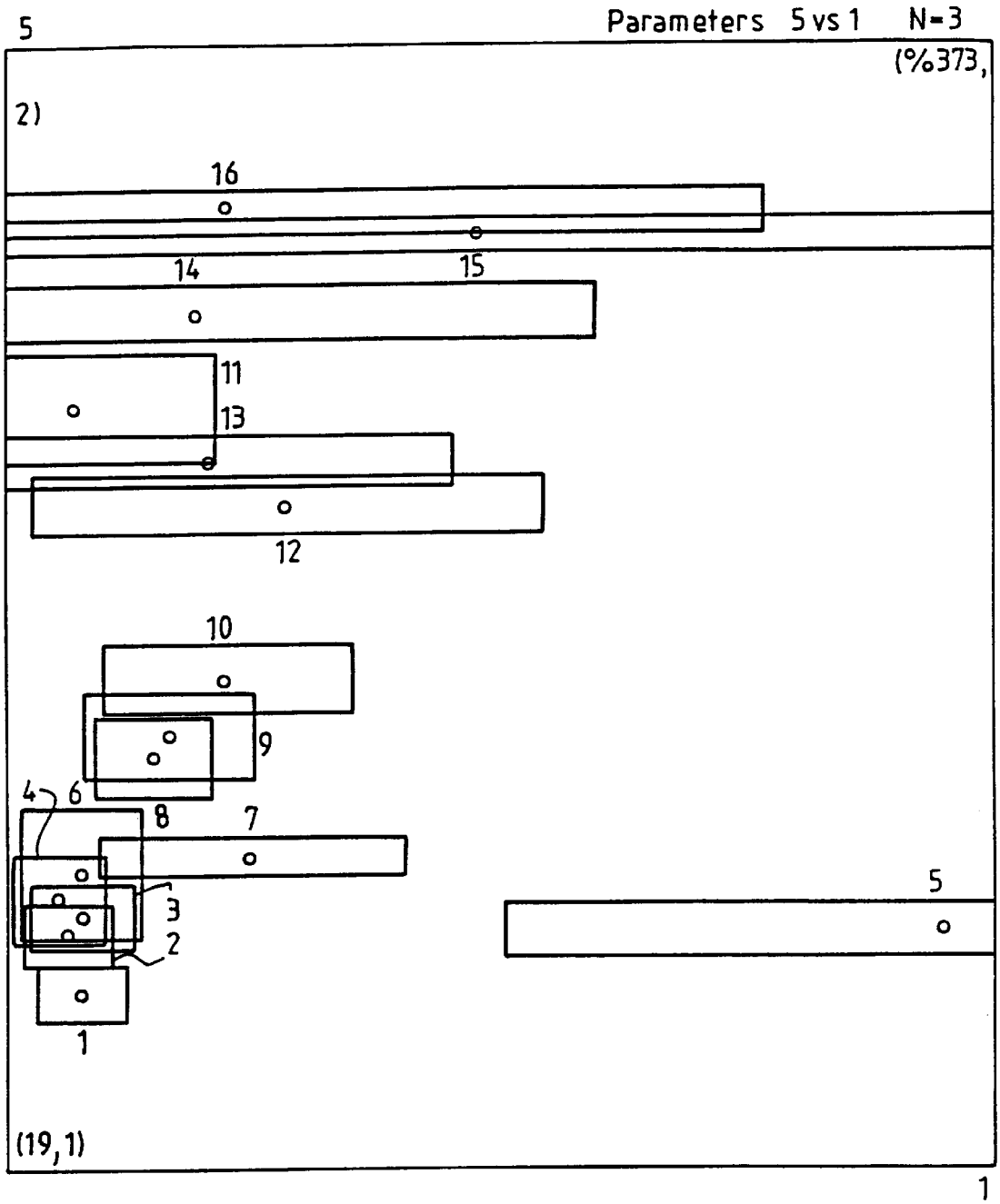
Figure 30:
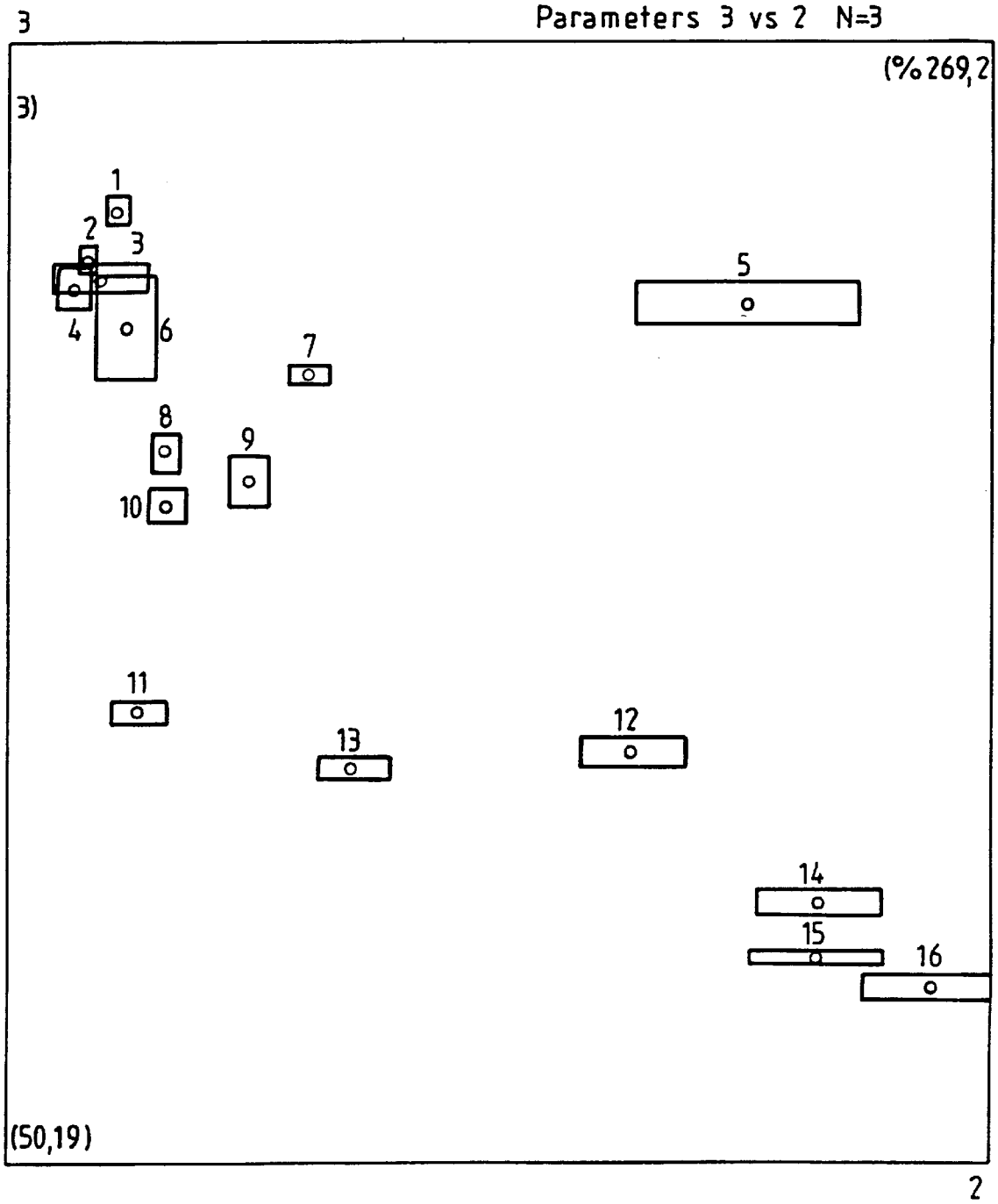
Figure 31:
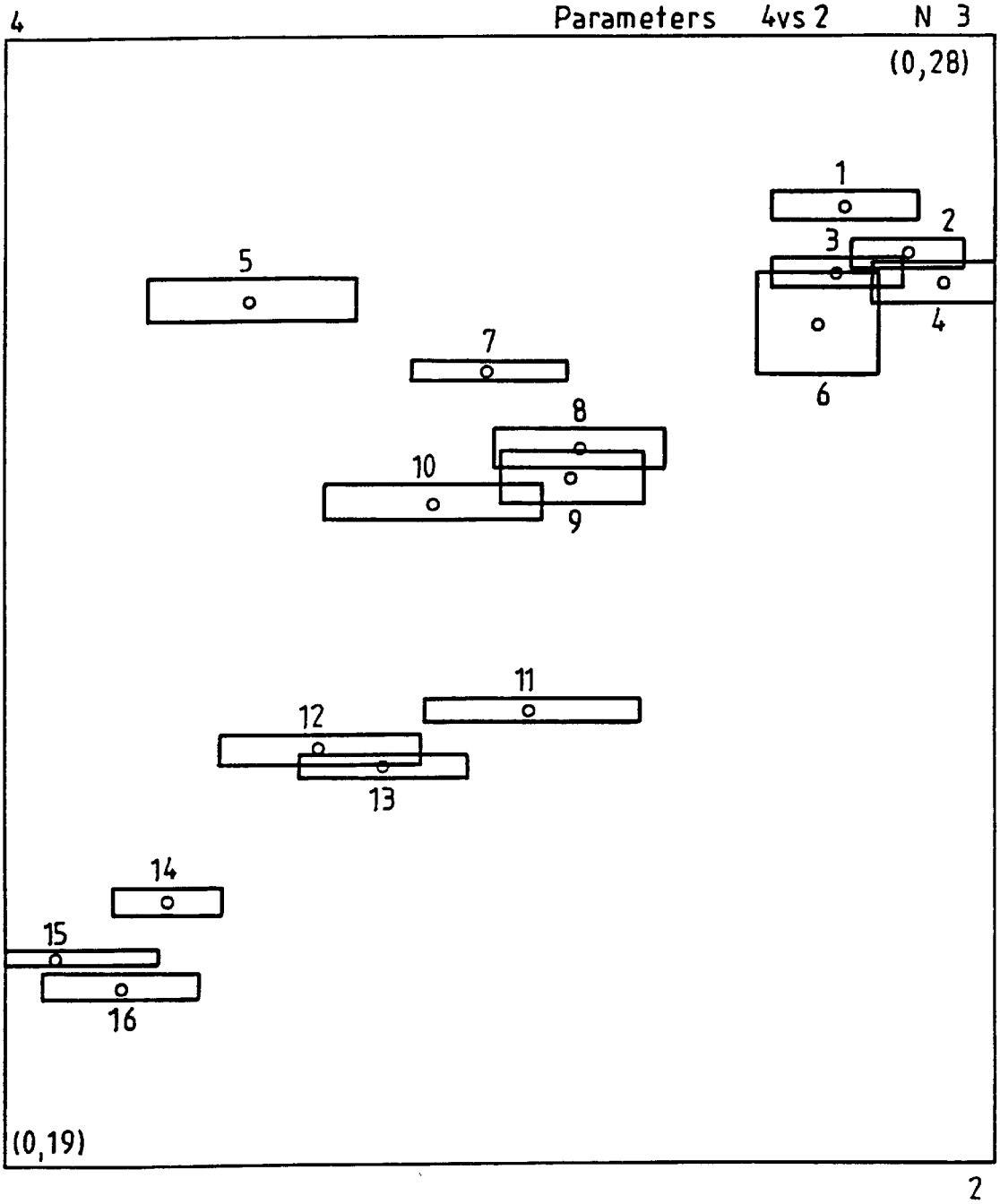
Figure 32:
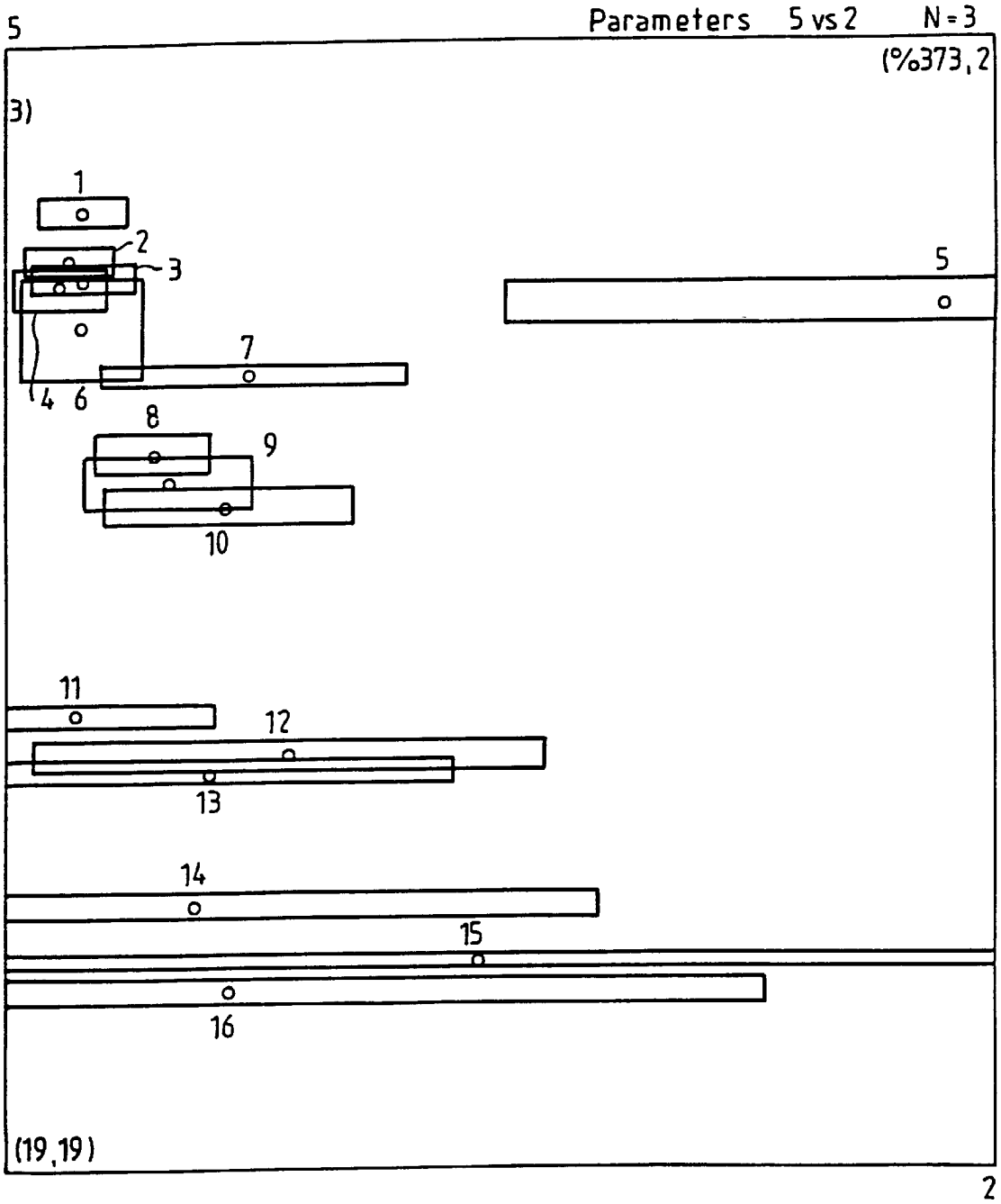
Figure 33:
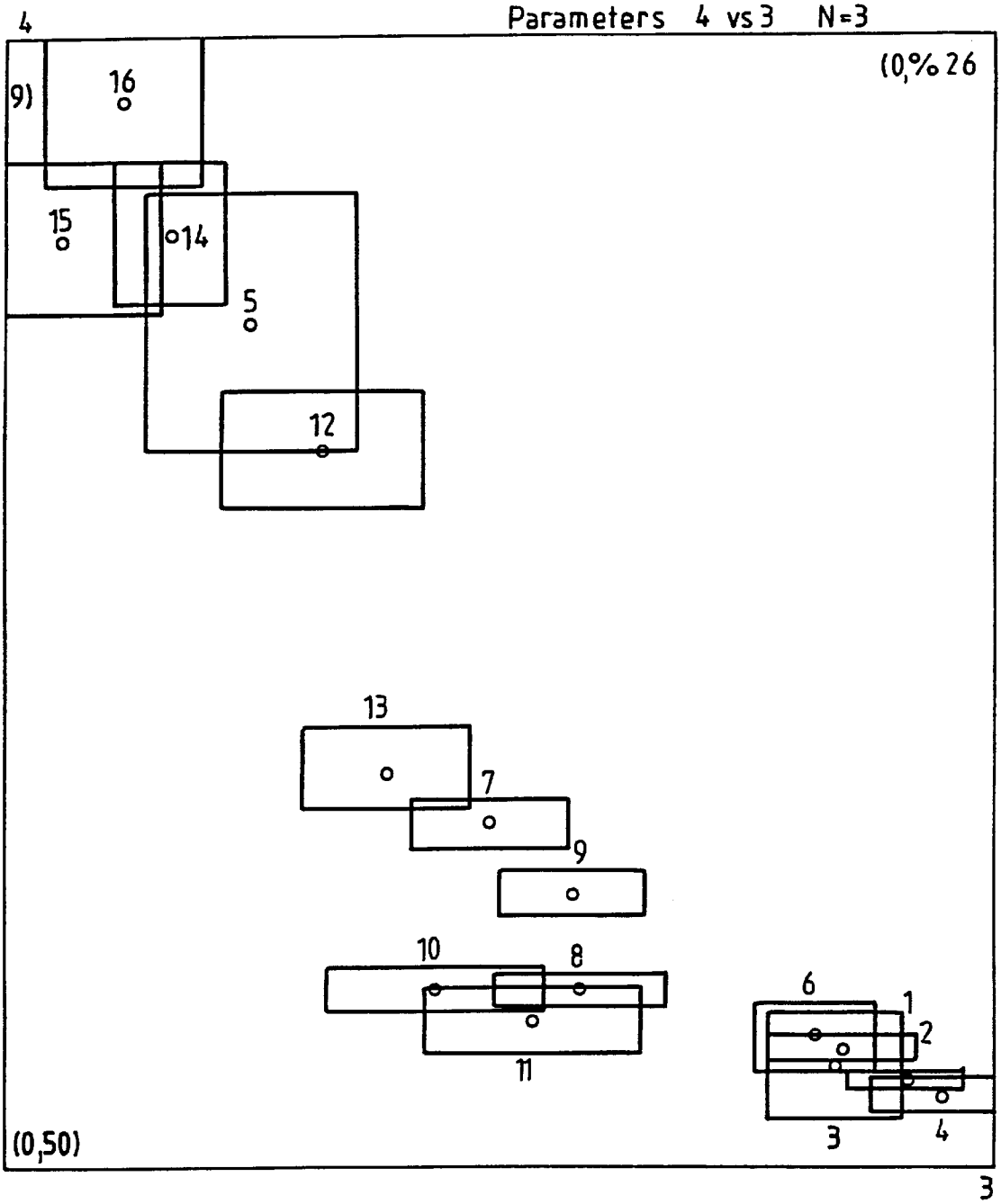
Figure 34:
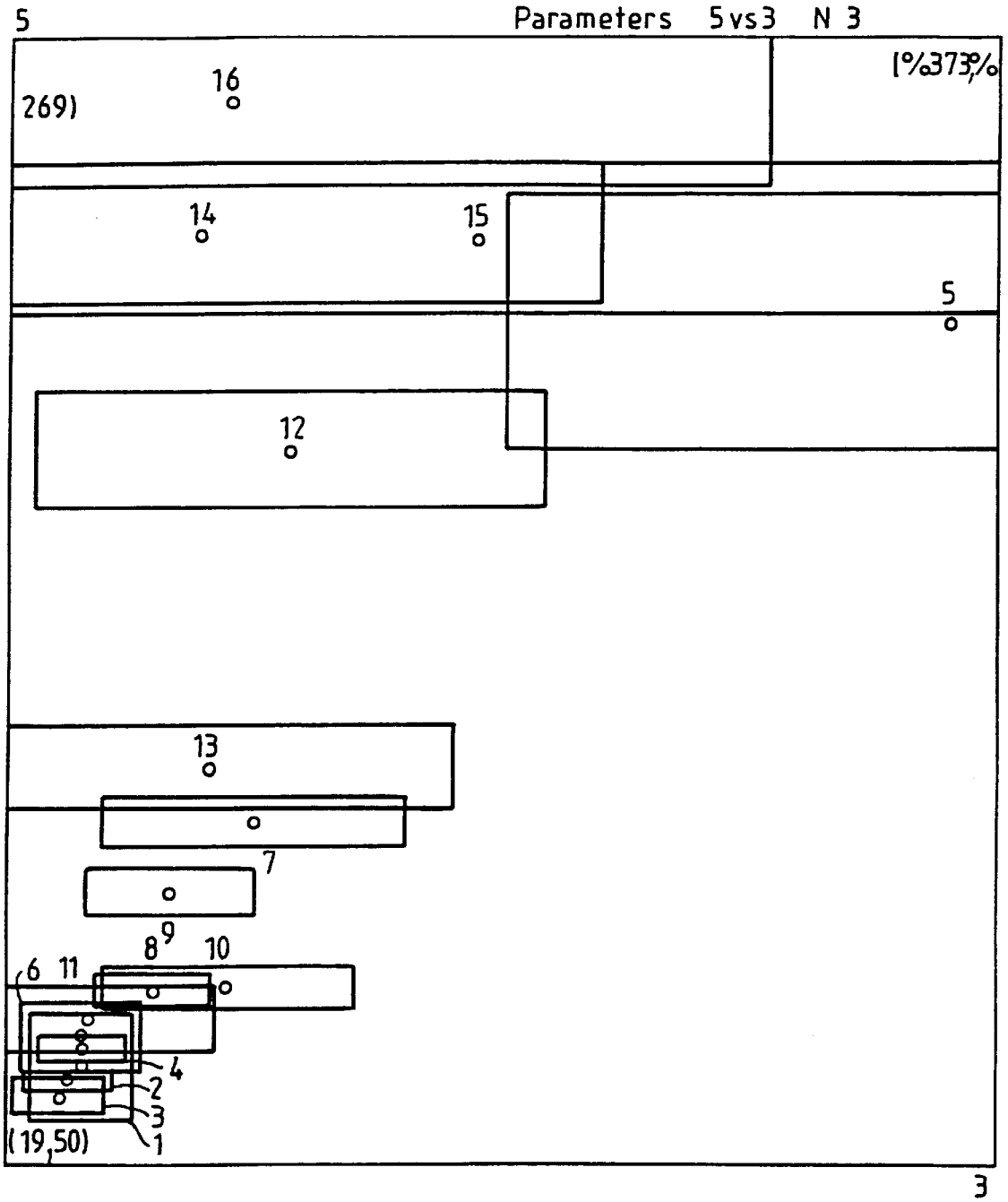
Figure 35:
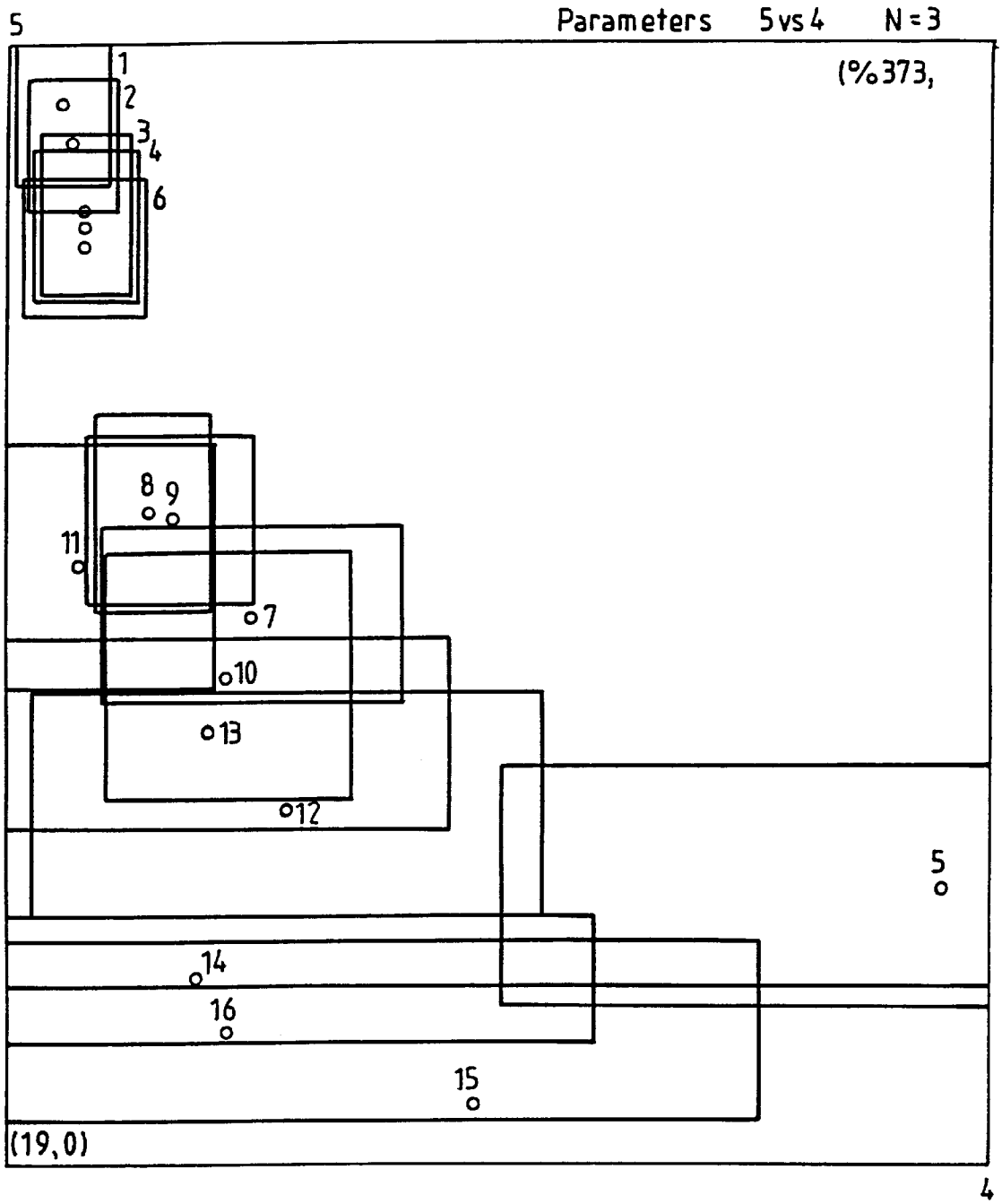

FIGS. 15 and 16 show other characteristics of the back emf oscillating waveform of a single coin which can be used. For example in FIGS. 15 and 16 different mean points of time are established for when the oscillations have dissipated to a predetermined amount.

If one considers the variables mentioned above in a specific combination, it is possible to discriminate between coins having very similar characteristics.

By use of a circuit which can functionally be defined as:

$$V(t)=Ae^{-\sigma t}\sin(\omega t+\phi)+Be^{-\alpha t}$$

("the formula")

where:

V(t) is the voltage at time t

A is the amplitude of the oscillation waveform

B is the amplitude of the direct current component $\phi$ is the phase angle of the response triggering delay $\omega$ is $2\pi f$ $f$ is the frequency of oscillation $\sigma$ is the decay associated with the oscillating waveform $\alpha$ is the decay associated with the direct current component, one can subject a coin with a single pulse, consider the results of that pulse, and compare with the known data for known coins.

An analysis of captured data for a series of 34 coins is included in Table 1 below. In this analysis a curve-fitting program has been used to fit the captured data to the formula. This data represents the average data for a large set of captured samples, for example, 100 of each coin type. The spread of the calculated variables from the samples is calculated as a Standard Deviation ("SD") expressed as a percentage. In the table "Sigma" is $\sigma$ in the formula, and "Alpha" is $\alpha$ in the formula.

It is clear from Table 1 that A, $\sigma$ (Sigma) and $f$ are three significant variables. B and $\alpha$ (Alpha) are relatively minor terms with a high range of spread. The utilisation of these additional two variables will allow for a higher degree of selectivity of coins, and improved accuracy. A and B may not be distinguished, if required. Also, $\sigma$ and $\alpha$ may not be distinguished. The net effect of the combination of A, B, $\sigma$ and $\alpha$ may be considered.

Therefore, by considering each of the variables alone, or in any combination, the back EMF of a coin can be compared with known criteria and its nature determined.

An example of the oscillating waveform, together with the curve $A\,e^{-\sigma t}$, and 10 times $Be^{-\alpha t}$, for each of the coins numbered 1, 2, 3, 5, 7, 9, 11, 13 and 15 respectively, is shown in FIGS. 17 to 25. The "noise" curve along the axis is a plot of 10 times the difference between the measured value and the calculated value from the curve. After taking into account the 10 times multiple, it is clear the curve fitting has resulted in a high degree of fit between measured and calculated values.

FIGS. 26 to 35 show a series of graphic representations that demonstrate the ability of the principal variables A, $f$, $\sigma$ (Sigma), B and $\alpha$ (Alpha) to distinguish the various coin sets. The ability of each variable to distinguish one coin from the other is demonstrated by plotting one variable against the other variable for the coin sets. These plots are based on using these variables. Overlaps of the rectangles indicates a lack of clear discrimination. Total discrimination is achieved by using more than one variable.

To achieve an equivalent to the combined effects of A/B, integration of the waveform for an odd number of half-cycles should be performed as the integration of the odd number of half waves is proportional to the magnitude of the first half cycle waveform. Integration of an even number of half-cycles is a measure of $\sigma/\alpha$ as the difference between the first and second half cycle provides an indication of the rate of decay of the waveform. The measurement of the period for a number of cycles provides and indication of the frequency, $f$.

This methodology has been demonstrated to produce a high level of discrimination of the World Coin Sets.

To refer now to FIG. 36, there is shown a circuit which can be used to conduct the discrimination referred to above.

Coils S1 and S2 are connected in series and are magnetically coupled. Capacitor S3 is connected across the coils at the points S11 and S21.

Energisation of the coils S1 and S2 is controlled by switch S4 which in turn is controlled by output O1 of microprocessor S8. Microprocessor S8 makes the decision with respect to the coil energisation upon reception of the trigger information from the optocouples block S9 through the input I4, I5 & I6 of microprocessor S8.

After coil S1,S2 is switched off under the control of microprocessor S8 it produces a back EMF oscillating voltage waveform.

The waveform is applied to the zero-crossing detector at point S21 and logic circuitry S5 at point S51, to the half period waveform integrator S6 at S61 and to the decay integrator of the even number of half periods S7 at S71.

The zero-crossing detector and logic current S65 produces three outputs. The outputs are as follows:

i) at output S52 a signal proportional to the half-period of the oscillating waveform;

ii) at output S53 a signal proportional to the even number of half-periods of the oscillating waveform;

iii) at output S54 a signal proportional to the period of the oscillating waveform.

The half-period waveform integrator S6 integrates the input waveform S61 for the duration that an output is present at S62 for the zero crossings and logic circuit S5 which is present for an odd number of waveforms.

When S62 is deactivated a stored integrated signal in S6 is discharged with a predetermined time constant. The period of the discharge is proportional to the integration of the area under the curve of the oscillating waveform. That information is presented at output S63 to the input I1 of the microprocessor S8.

The integration of an odd number of waveforms represents the combined effect of A and B of the formula.

At the same time the oscillating waveform is presented to S7 and S71 and the signal is integrated for the period that S72 is active. Upon the deactivation of S72, the remaining stored signal value in S7 is discharged at a constant rate such that the period of discharge is proportional to the decay information of the oscillating waveform. This signal is presented at S73 to the microprocessor S8 at the input I2.

The integration of an even number of waveforms provides an indication of the combined effects of $\sigma$ and $\alpha$ of the formula.

At the same time the zero crossing detector and logic circuit S5 produces an output signal S54 proportional to the period of the frequency of oscillation of the oscillating waveform. This signal is presented at I3 to the microprocessor 58 at the input I3.

The microprocessor S8 compares the signals at I1, I2, and I3 with a data base of stored values within the microprocessor S8 and establishes the validity and denomination of a coin against values stored into the microprocessor from reference data.

If a match is found, output O2 of microprocessor S8 is activated and presented to the output activation stage S10 at point S101.

It is to be realised that the actual number of waveforms considered is not important, but the accuracy of the results is higher for some of the variables by selecting a larger number of cycles of the waveform. Also, it is preferred that the determinations are made on the basis of time. When the initial pulse applied to the coils stops, the internal clock in the microprocessor starts so that time, in the form of clock pulses, can be measured. In the case of frequency, for example, when a predetermined number of half-wave crossings have occurred a signal is applied to the microprocessor to note the number of clock counts. That number is proportional to the frequency of the waveform.

TABLE 1

| | Coin Code | Amp A Volts | Frequ kHz | sigma U-Sec | Amp B Volts | alpha U-Sec | SD A % | SD F % | SD sigma % | SDb % | SD alpha % |
|---|---|---|---|---|---|---|---|---|---|---|---|
| 1 | AUS-99-$2-01 | 1.906 | 23.02 | 143.6 | 0.108 | 99.9 | 0.28 | 0.19 | 1.42 | 4.8 | 21.1 |
| 2 | FRA-00-F1-01 | 1.917 | 23.201 | 103.6 | 0.101 | 141.5 | 0.32 | 0.11 | 1.12 | 7 | 17.5 |
| 3 | HK-00-$2-L1 | 1.688 | 26.051 | 73.5 | 0.21 | 44.2 | 0.66 | 0.47 | 0.59 | 2 | 12.2 |
| 4 | HK-00$2-H1 | 1.678 | 26.156 | 76.3 | 0.205 | 47.3 | 0.7 | 0.47 | 0.61 | 2.2 | 10.6 |
| 5 | HK-00-$5-L1 | 1.658 | 26.47 | 68.8 | 0.214 | 45.4 | 0.37 | 00.4 | 0.5 | 1.7 | 11.7 |
| 6 | HK-00-$5-H1 | 1.654 | 26.513 | 70 | 0.21 | 47.4 | 0.3 | 00.6 | 0.39 | 1.6 | 8.7 |
| 7 | MEX-02-$5-L1 | 1.94 | 22.627 | 117.4 | 0.112 | 86.4 | 0.29 | 0.14 | 1.16 | 4.5 | 25 |
| 8 | MEX-02-$5-H1 | 1.946 | 22.483 | 136.4 | 0.102 | 96 | 0.23 | 0.09 | 0.46 | 6.8 | 27.5 |
| 9 | MEX-02-$500- | 1.655 | 26.554 | 63.8 | 0.236 | 38.9 | 0.4 | 0.16 | 0.74 | 1.4 | 13.1 |
| 10 | MEX-02-$500- | 1.634 | 26.739 | 69.4 | 0.221 | 44.1 | 0.3 | 0.09 | 0.45 | 2.1 | 11 |
| 11 | MEX-02-$1-L1 | 2.103 | 20.769 | 276.6 | 0.043 | 103.2 | 0.15 | 0.06 | 1.19 | 11.8 | 66.6 |
| 12 | MEX-02-$1-H1 | 2.093 | 20.894 | 236.2 | 0.049 | 93.1 | 0.2 | 0.13 | 2.47 | 11.2 | 60.9 |
| 13 | MEX-02-20-L1 | 2.041 | 21.455 | 225.5 | 0.056 | 81 | 0.25 | 0.12 | 1.74 | 5.9 | 56.5 |
| 14 | MEX-02-20-H1 | 2.028 | 21.54 | 235.9 | 0.058 | 92.9 | 0.29 | 0.16 | 1.87 | 7.4 | 50.6 |
| 15 | AUS-02-05-L1 | 2.083 | 21.059 | 226.7 | 0.031 | 171 | 0.13 | 0.06 | 1.87 | 20.1 | 47.1 |
| 16 | AUS-02-05-H1 | 2.084 | 21.035 | 233.1 | 0.032 | 202.5 | 0.13 | 0.05 | 1.64 | 25.7 | 51.3 |
| 17 | AUS-02-10-L1 | 1.985 | 22.928 | 77.5 | 0.138 | 43.8 | 0.54 | 0.13 | 0.91 | 5.8 | 33.4 |
| 18 | AUS-02-10-H1 | 1.965 | 23.071 | 79.6 | 0.145 | 43.4 | 0.49 | 0.12 | 0.93 | 4.5 | 31.3 |
| 19 | AUS-02-20-L1 | 1.677 | 26.331 | 61.2 | 0.244 | 35.8 | 0.35 | 0.1 | 0.45 | 1.1 | 12.7 |
| 20 | AUS-02-209-H1 | 1.657 | 26.517 | 65.8 | 0.23 | 40.1 | 0.33 | 0.1 | 0.52 | 1.6 | 11.8 |
| 21 | AUS-02-50-L1 | 1.613 | 26.985 | 71.4 | 0.218 | 44.6 | 0.31 | 0.12 | 0.85 | 2.2 | 10.9 |
| 22 | AUS-02-50-H1 | 1.604 | 27.081 | 74.2 | 0.209 | 48.3 | 0.28 | 0.11 | 0.86 | 2.8 | 11 |
| 23 | AUS-02-$1-L1 | 1.697 | 25.696 | 112.5 | 0.135 | 99.3 | 0.24 | 0.09 | 0.45 | 5 | 13.7 |
| 24 | AUS-02-$1-H1 | 1.691 | 25.713 | 120.6 | 0.128 | 114.1 | 0.21 | 0.09 | 0.39 | 4.1 | 10.7 |
| 25 | AUS-02-$2-L1 | 1.921 | 22.662 | 181.8 | 0.094 | 112.3 | 0.22 | 0.1 | 0.73 | 7.9 | 27.1 |
| 26 | AUS-02-$2-H1 | 1.908 | 22.734 | 195.8 | 0.091 | 126.4 | 0.21 | 0.12 | 0.82 | 7.5 | 20.4 |
| 27 | UK-06-02-L1 | 1.648 | 26.267 | 208.4 | 0.077 | 339.9 | 0.24 | 0.11 | 0.64 | 9.2 | 13.9 |

TABLE 1-continued

| | Coin Code | Amp A Volts | Frequ kHz | sigma U-Sec | Amp B Volts | alpha U-Sec | SD A % | SD F % | SD sigma % | SDb % | SD alpha % |
|---|---|---|---|---|---|---|---|---|---|---|---|
| 28 | UK-06-02-H1 | 1.646 | 26.3 | 218.5 | 0.074 | 369.7 | 0.27 | 0.14 | 0.77 | 9.7 | 14.9 |
| 29 | CAN-02-$1-L1 | 1.804 | 24.654 | 85.8 | 0.117 | 102 | 0.32 | 0.12 | 1.13 | 6.5 | 15 |
| 30 | CAN-02-$1-H1 | 1.804 | 24.678 | 83.1 | 0.12 | 94.1 | 0.32 | 0.14 | 1.03 | 5.3 | 14 |
| 31 | FIN-02-M5-L1 | 1.771 | 24.845 | 100 | 0.153 | 71.9 | 0.34 | 0.14 | 0.69 | 2.4 | 14.4 |
| 32 | FIN-02-M5-H1 | 1.765 | 24.882 | 105.7 | 0.149 | 82.3 | 0.28 | 0.13 | 0.69 | 2.1 | 10.2 |
| 33 | FIN-02-M10-L | 1.759 | 25.055 | 86.1 | 0.15 | 75.1 | 0.28 | 0.08 | 0.55 | 3.9 | 9.9 |
| 34 | FIN-02-M10-H | 1.754 | 25.135 | 81.8 | 0.155 | 68.3 | 0.31 | 0.15 | 1.01 | 3.4 | 9.1 |

We claim:

1. A method of categorizing coins/tokens, including the steps of:

(a) energizing detect coils, between which at least part of a coin/token is located, with a single pulse, (b) detecting the unmodified back EMF curve of the decaying pulse, (c) analyzing said unmodified back EMF curve to measure at least one characteristic of said unmodified back EMF curve, (d) comparing said at least one characteristic with the corresponding characteristic(s) of a reference unmodified back EMF curve to determine therefrom into which of a number of predetermined categories said coin/token falls.

2. A method as claimed in claim 1, wherein said at least one characteristic of said unmodified back EMF curve includes any one or more of; the amplitude of the oscillating wave form, the amplitude of the direct current component, the phase angle of the response triggering delay, the frequency of oscillation, the decay associated with the oscillating waveform, and the decay associated with the direct current component.

3. A method as claimed in claim 2, wherein the amplitude of the oscillating wave form, the amplitude of the direct current component, the decay associated with the oscillating waveform, and the decay associated with the direct current component are the characteristics used as the basis of said comparison.

4. A method as claimed in claim 1, wherein said at least one characteristic of said unmodified back EMF curve comprises a superimposition of a mean amplitude curve.

5. A method as claimed in claim 1, wherein said at least one characteristic of said unmodified back EMF curve comprises the phase and/or change in phase of the oscillating waveform.

6. A method as claimed in claim 1, wherein said at least one characteristic of said unmodified back EMF curve comprises the curves plotted by the peaks of either or both of the positive and/or negative portions of the oscillating waveform, and the amplitude of the negative and/or positive peaks of the oscillating waveform.

7. A method as claimed in claim 1, wherein said at least one characteristic of said unmodified back EMF curve comprises the area of the curve beneath the peaks of the oscillating waveform.

8. A method as claimed in claim 1, wherein said at least one characteristic of said unmodified back EMF curve comprises the frequency and/or change in frequency of the oscillating waveform.

9. A method as claimed in claim 1, wherein said at least one characteristic of said unmodified back EMF curve comprises the decay of the peaks of the oscillating waveform in a predetermined time.

10. A method as claimed in claim 1, wherein said at least one characteristic of said unmodified back EMF curve comprises a combination of at least two characteristics selected from the group consisting of:

(a) representation of a superimposition of a mean amplitude curve;

(b) representation of the phase of the oscillating waveform;

(c) representation of the change in phase of the oscillating waveform;

(d) representation of the curve plotted by the peaks of the positive portions of the oscillating waveform, and the amplitude of those peaks;

(e) representation of the curve plotted by the peaks of the positive portions of the oscillating waveform, and the amplitude of the peaks of the negative portions of the oscillating waveform;

(f) representation of the curve plotted by the peaks of the negative portions of the oscillating waveform, and the amplitude of those peaks;

(g) representation of the curve plotted by the peaks of the negative portions of the oscillating waveform, and the amplitude of the peaks of the positive portions of the oscillating waveform;

(h) representation of the curves plotted by the peaks of both the positive and the negative portions of the oscillating waveform, and the amplitude of those peaks;

(I) representation of the areas of the curves beneath the peaks of the oscillating waveform;

(j) representation of the frequency of the oscillating waveform;

(k) representation of the change in frequency of the oscillating waveform;

(l) representation of the frequency and the change in frequency of the oscillating waveform; and (m) representation of the decay of the peaks of the oscillating waveform in a predetermined time.

11. A method of catagorising coins/tokens, including the steps of:

(a) energising detect coils, between which at least a part of a coin/token is located, with a single pulse, (b) detecting the back EMF curve of the decaying pulse information, (c) analysing the unmodified back EMF curve to extract therefrom a number of variables and processing those variables to provide values proportional to the variables, (d) comparing said values of said coin/token with a number of reference values to determine into which of a number of pre-determined categories said coin token falls; said comparison being made using the formula $$V(t)=Ae^{-\sigma t}\sin(\omega t+\phi)+Be^{-\alpha t}$$

wherein:

V(t) is the voltage at time t

A is the amplitude of the oscillating waveform

B is the amplitude of the direct current component $\phi$ is the phase angle of the response triggering delay $\omega$ is $2\pi f$ $f$ is the frequency of oscillation $\sigma$ is the decay associated with the oscillating waveform $\alpha$ is the decay associated with the direct current component.

12. A method as claimed in claim 11, wherein an indication of the combined effects of A and B is obtained by integration of the back EMF curve for an odd number of half-cycles.

13. A method as claimed in claim 11, wherein an indication of the combined effects of $\sigma$ and $\alpha$ is obtained by integration of an even number of half-cycles.

14. A method as claimed in claim 11, wherein an indication of the frequency is obtained by the measurement of the period for a number of cycles.

15. A method of categorizing coins/tokens, including the steps of:

(a) energizing detect coils, between which at least part of a coin/token is located, with a single pulse;

(b) detecting the back EMF curve of the decaying pulse information;

(c) analyzing the unmodified back EMF curve to extract therefrom one or more variables and processing said one or more variables to provide values proportional to said one or more variables; and (d) comparing said values of said coin/token with at least one of a number of reference values to determine into which of a number of predetermined categories said coin/token falls, wherein said comparison is made using the formula $$V(t)=Ae^{-\sigma t}\sin(\omega t+\phi)+Be^{-\alpha t}$$

wherein:

V(t) is the voltage at time t

A is the amplitude of the oscillating wave form

B is the amplitude of the direct current component $\phi$ is the phase angle of the response triggering delay $\omega$ is $2\pi f$ $f$ is the frequency of oscillation $\sigma$ is the decay associated with the oscillating waveform $\alpha$ is the decay associated with the direct current component.

16. A method of categorizing coins/tokens, including the steps of:

(a) energizing detect coils, between which at least part of a coin/token is located, with a single pulse;

(b) detecting the back EMF curve of the decaying pulse information;

(c) analyzing the unmodified back EMF curve to extract therefrom one or more variables and processing said one or more variables to provide values proportional to said one or more variables; and (d) comparing said values of said coin/token with at least one of a number of reference values to determine into which of a number of predetermined categories said coin/token falls, wherein the step of analyzing the unmodified back EMF curve comprises the steps of:

comparing said unmodified back EMF curve to a reference unmodified back EMF curve; and determining said values by calculating the difference of said one or more variables between said unmodified back EMF curve and said reference unmodified back EMF curve.

* * * * *